US010288022B2

(12) United States Patent
Yasukawa et al.

(10) Patent No.: US 10,288,022 B2
(45) Date of Patent: May 14, 2019

(54) ELECTROMAGNETIC FUEL INJECTOR

(71) Applicant: Hitachi Automotive Systems, Ltd., Hitachinaka-shi, Ibaraki (JP)

(72) Inventors: Yoshihito Yasukawa, Hitachinaka (JP); Hideharu Ehara, Hitachinaka (JP); Tohru Ishikawa, Hitachinaka (JP); Kiyotaka Ogura, Hitachinaka (JP); Motoyuki Abe, Tokyo (JP); Ryo Kusakabe, Tokyo (JP); Akiyasu Miyamoto, Tokyo (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 0 days.

(21) Appl. No.: 14/774,925

(22) PCT Filed: Jan. 27, 2014

(86) PCT No.: PCT/JP2014/051616
§ 371 (c)(1),
(2) Date: Sep. 11, 2015

(87) PCT Pub. No.: WO2014/141757
PCT Pub. Date: Sep. 18, 2014

(65) Prior Publication Data

US 2016/0025052 A1 Jan. 28, 2016

(30) Foreign Application Priority Data

Mar. 14, 2013 (JP) ..... 2013-051103

(51) Int. Cl.
*F02M 51/06* (2006.01)
*F02M 63/00* (2006.01)
*F02M 61/04* (2006.01)

(52) U.S. Cl.
CPC .... *F02M 51/0614* (2013.01); *F02M 51/0625* (2013.01); *F02M 51/0671* (2013.01);
(Continued)

(58) Field of Classification Search
CPC ..... F02M 51/00; F02M 51/0603; F02M 51/0671; F02M 51/061; F02M 51/066;
(Continued)

(56) References Cited

U.S. PATENT DOCUMENTS 5,632,467 A * 5/1997 Just ..... F02M 51/0671 239/585.4
7,063,279 B2 * 6/2006 Mizuno ..... F02M 51/005 239/585.1

(Continued)

FOREIGN PATENT DOCUMENTS

JP 11-44275 A 2/1999
JP 2000-46224 A 2/2000

(Continued)

OTHER PUBLICATIONS

International Search Report (PCT/ISA/210) dated May 13, 2014 with English-language translation (five (5) pages).

*Primary Examiner* — Alexander M Valvis
*Assistant Examiner* — Christopher R Dandridge
(74) *Attorney, Agent, or Firm* — Crowell & Moring LLP

(57) ABSTRACT

In an electromagnetic fuel injection which is structured such that both end surfaces of an inner circumferential iron core portion and an outer circumferential iron core portion face a movable iron core, and a non-magnetic portion made of a metal material is provided between both end surfaces, an object of the present invention is to realize a structure of the electromagnetic fuel injector in which a surface of a target object is unlikely to be affected by a heat treatment with the surface facing the movable iron core. In an electromagnetic (Continued)

fuel injector 1 of the present invention which is structured such that both end surfaces of an inner circumferential iron core portion 401*a* and an outer circumferential iron core portion 401*b* face a movable iron core 402, and a non-magnetic portion 401*d* made of a metal material is provided between both end surfaces, in order to achieve this object, heat in a target member to be heat treated is generated by applying energy to a target member's surface which is different from a target member's surface that faces the movable iron core 402. More preferably, energy is applied to a surface different from a surface on a side that faces the movable iron core 402.

16 Claims, 12 Drawing Sheets

(52) U.S. Cl.
CPC ..... *F02M 63/0012* (2013.01); *F02M 61/042* (2013.01); *F02M 2200/8084* (2013.01); *F02M 2200/9069* (2013.01)

(58) Field of Classification Search
CPC ..... F02M 51/0685; F02M 51/0635; F02M 51/0653; F02M 51/0614; F02M 51/0625; F02M 63/0012; F02M 61/042; F02M 2200/8084; F02M 2200/9069; F02M 2200/08; F02M 2200/16; F02M 51/017; F02M 51/0621; B05B 1/3013; B05B 1/3026; B05B 1/326; Y10S 239/90
USPC ..... 239/585.1–585.5
See application file for complete search history.

(56) References Cited

U.S. PATENT DOCUMENTS

| | | | | |
|---|---|---|---|---|
| 8,313,084 | B2 * | 11/2012 | Reiter | F02M 51/0678 123/490 |
| 2003/0151014 | A1 * | 8/2003 | Ogura | F02M 51/0671 251/129.15 |
| 2003/0178509 | A1 * | 9/2003 | Porter | B05B 1/3053 239/585.1 |
| 2004/0046138 | A1 * | 3/2004 | Stein | F02M 51/0603 251/129.06 |
| 2005/0006492 | A1 | 1/2005 | Brooks et al. | |

FOREIGN PATENT DOCUMENTS

| | | | |
|---|---|---|---|
| JP | 2000-274548 | A | 10/2000 |
| JP | 2005-307750 | A | 11/2005 |
| JP | 2007-500822 | A | 1/2007 |

* cited by examiner

[Fig. 1]
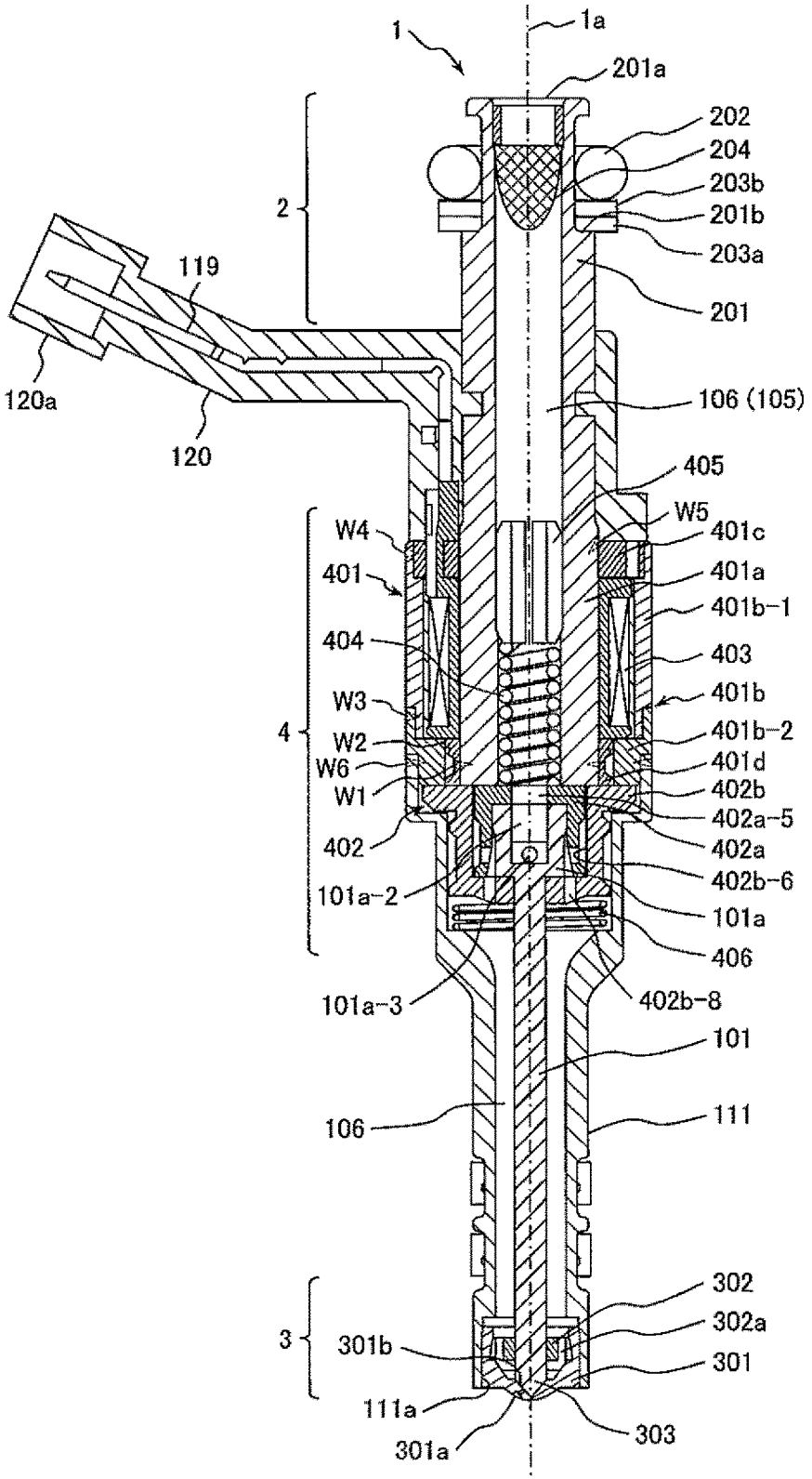

[Fig. 2]
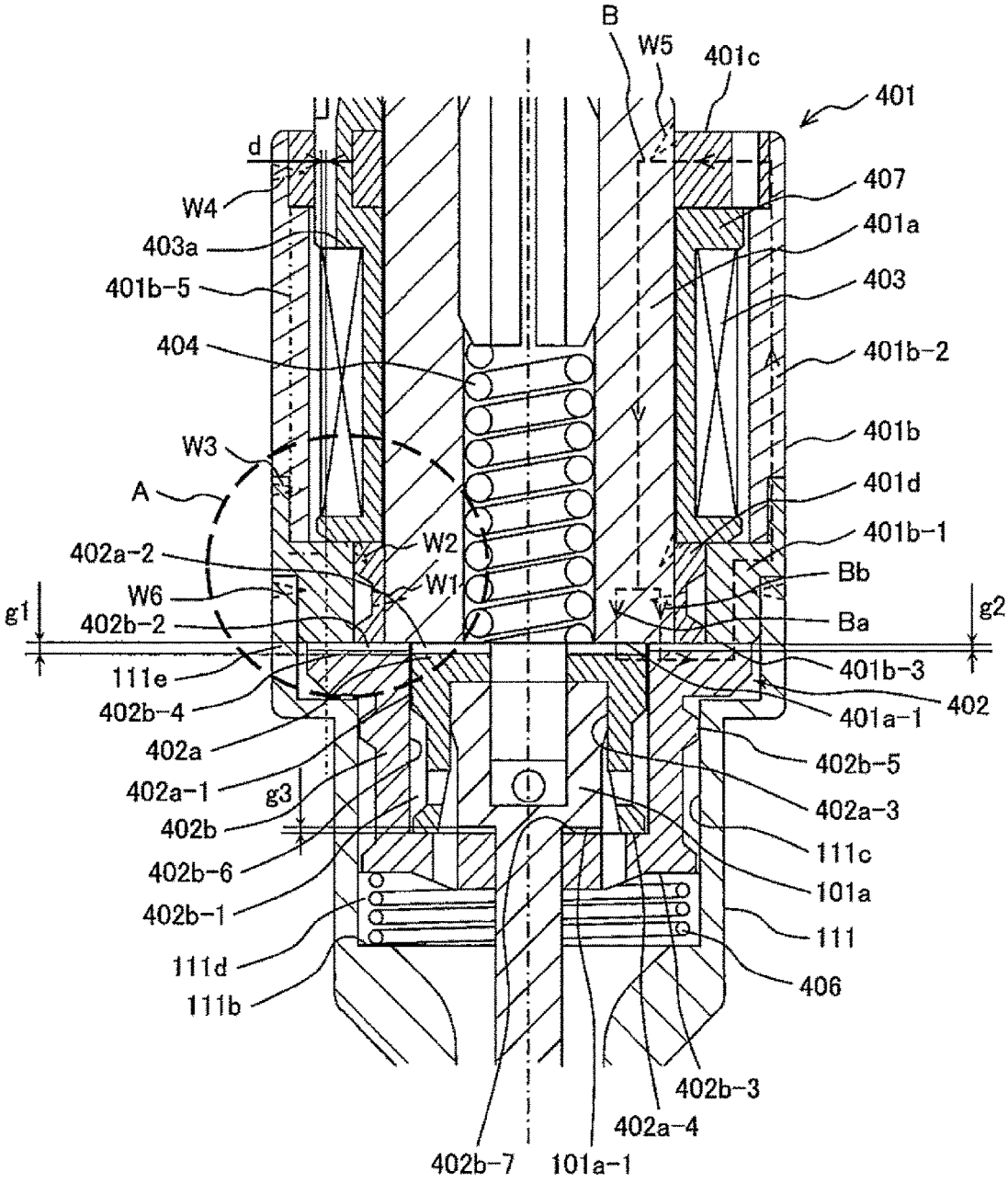

[Fig. 3]
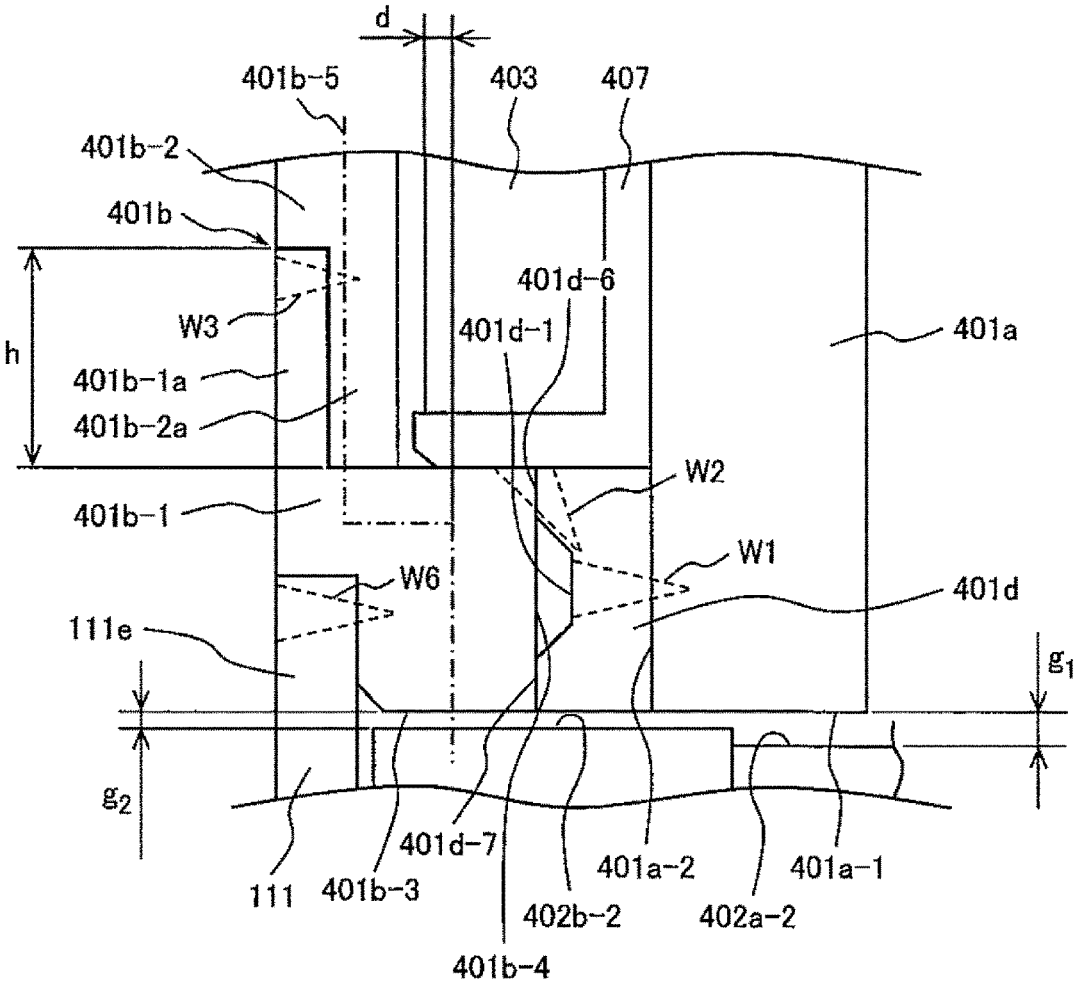

[Fig. 4]
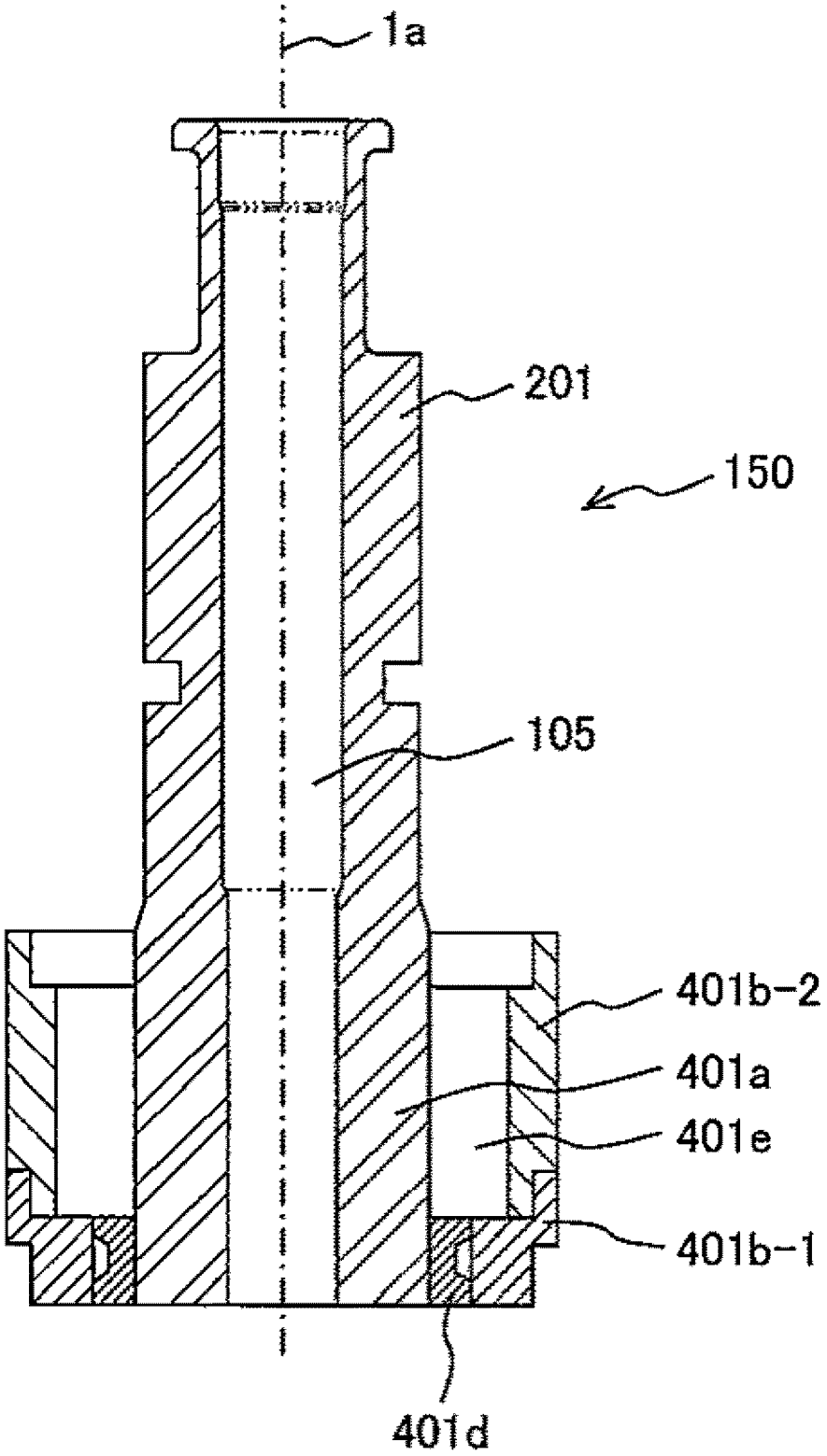

[Fig. 5]
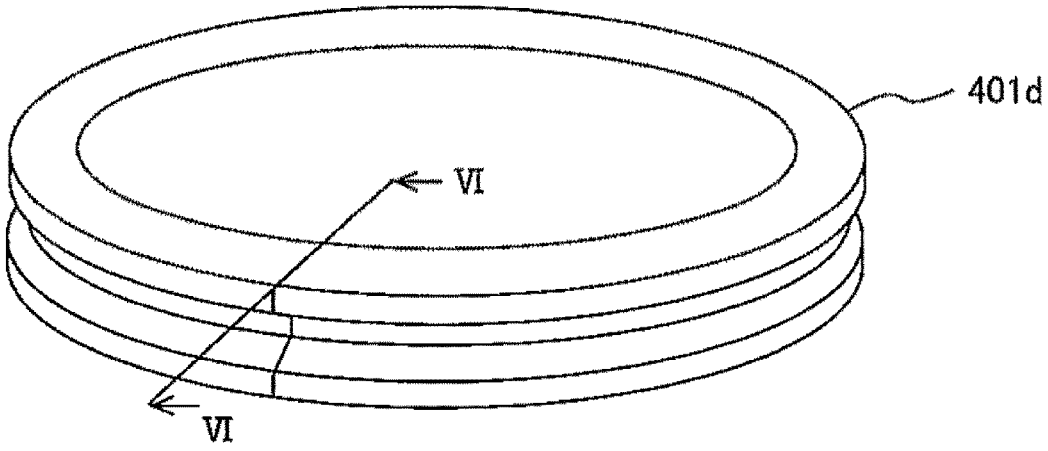

[Fig. 6]
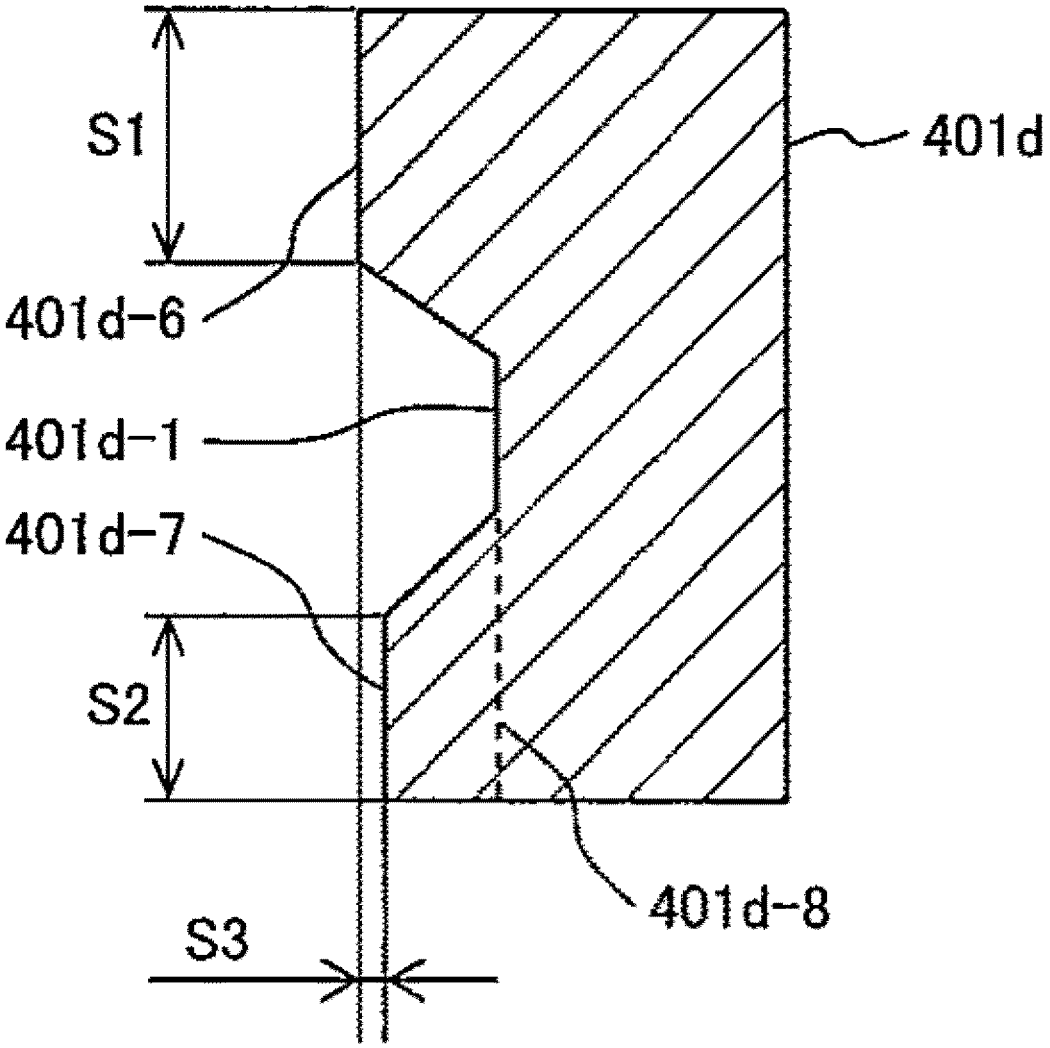

[Fig. 7]
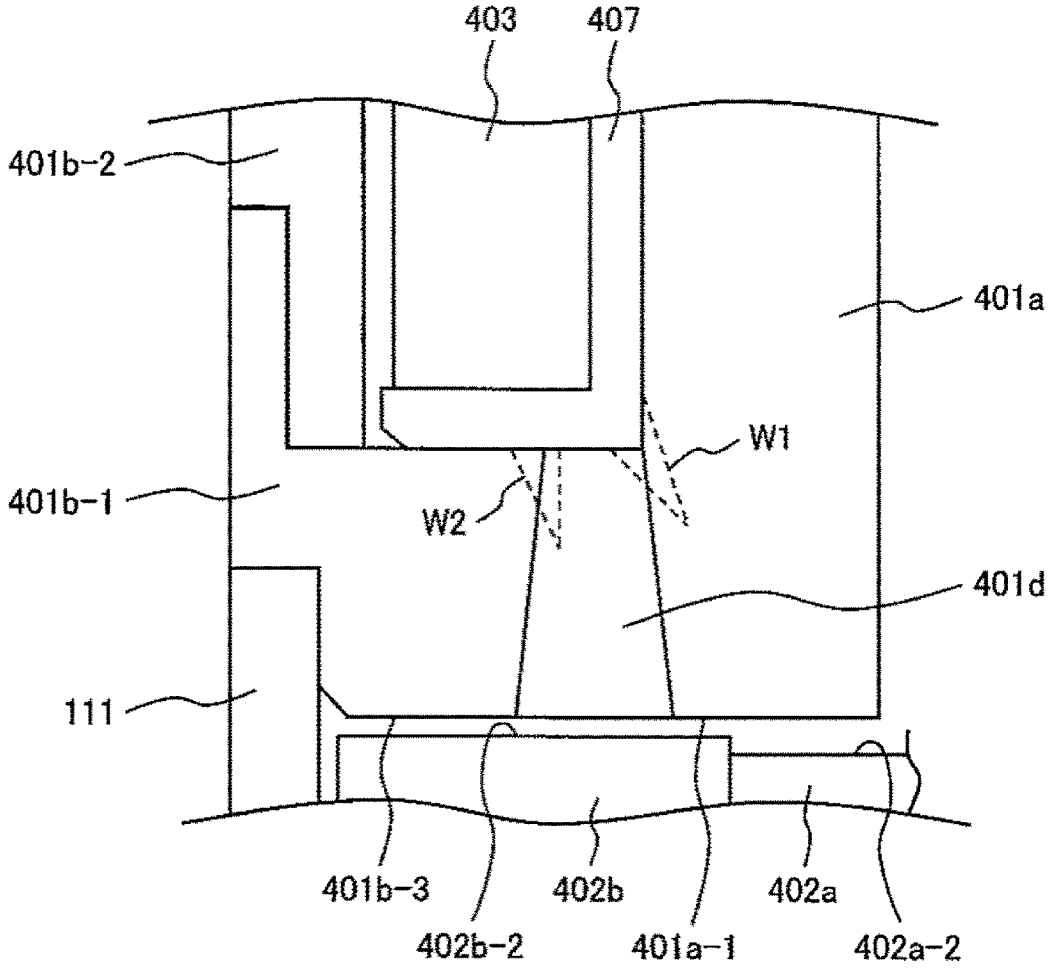

[Fig. 8]
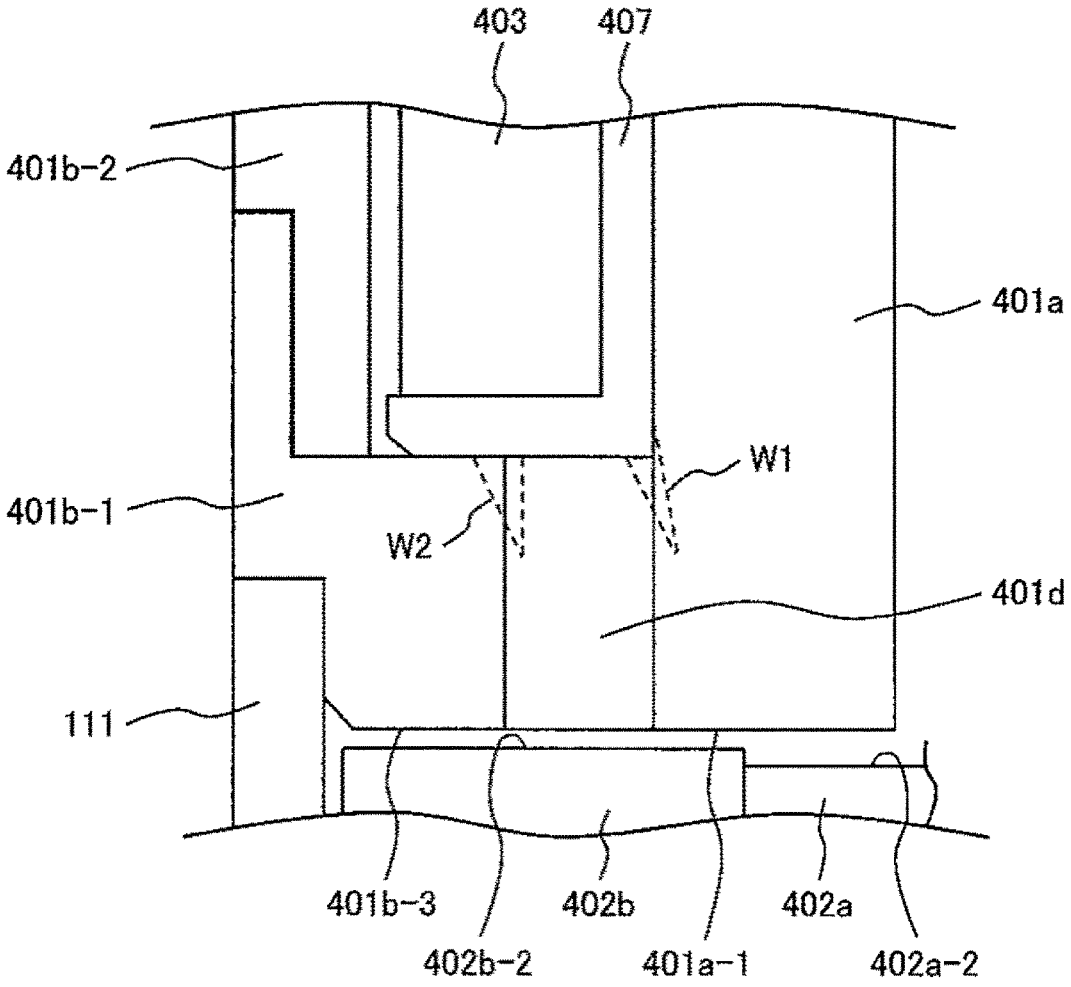

[Fig. 9]
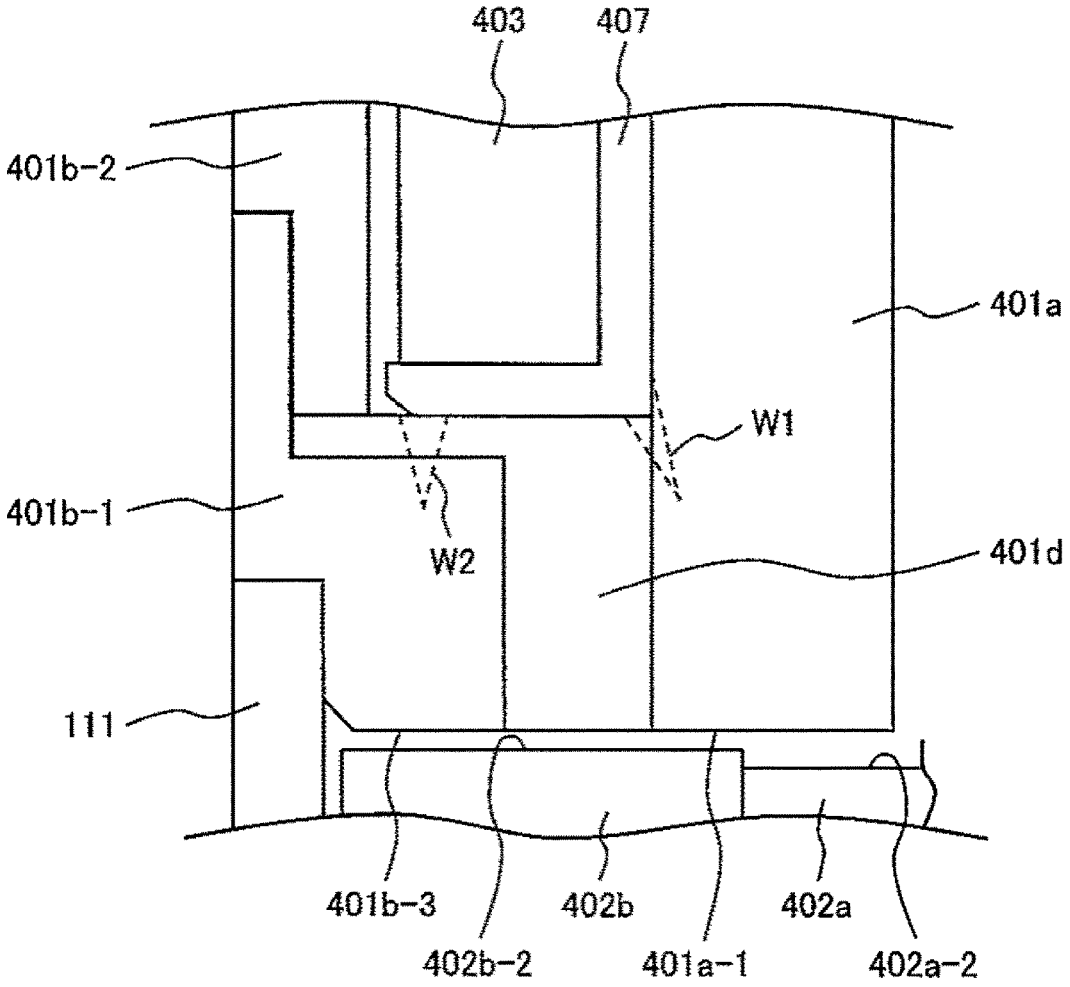

[Fig. 10]
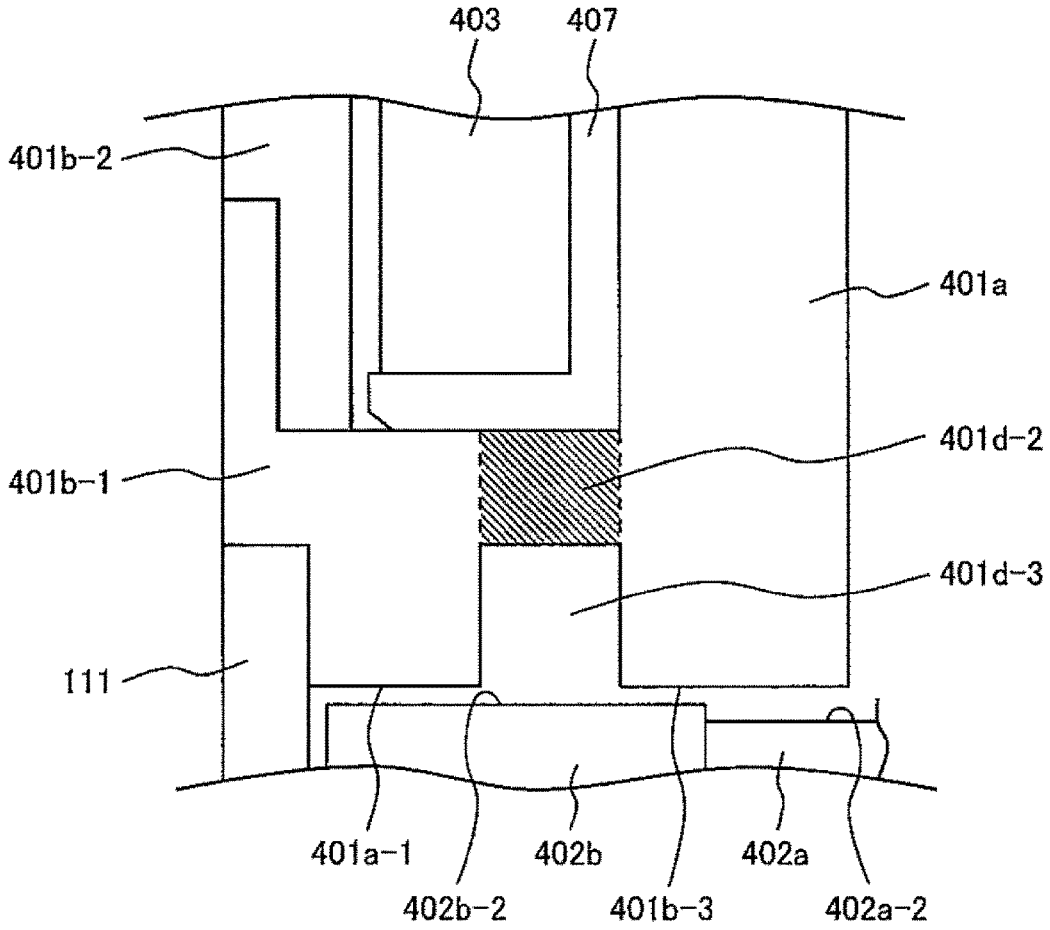

[Fig. 11]
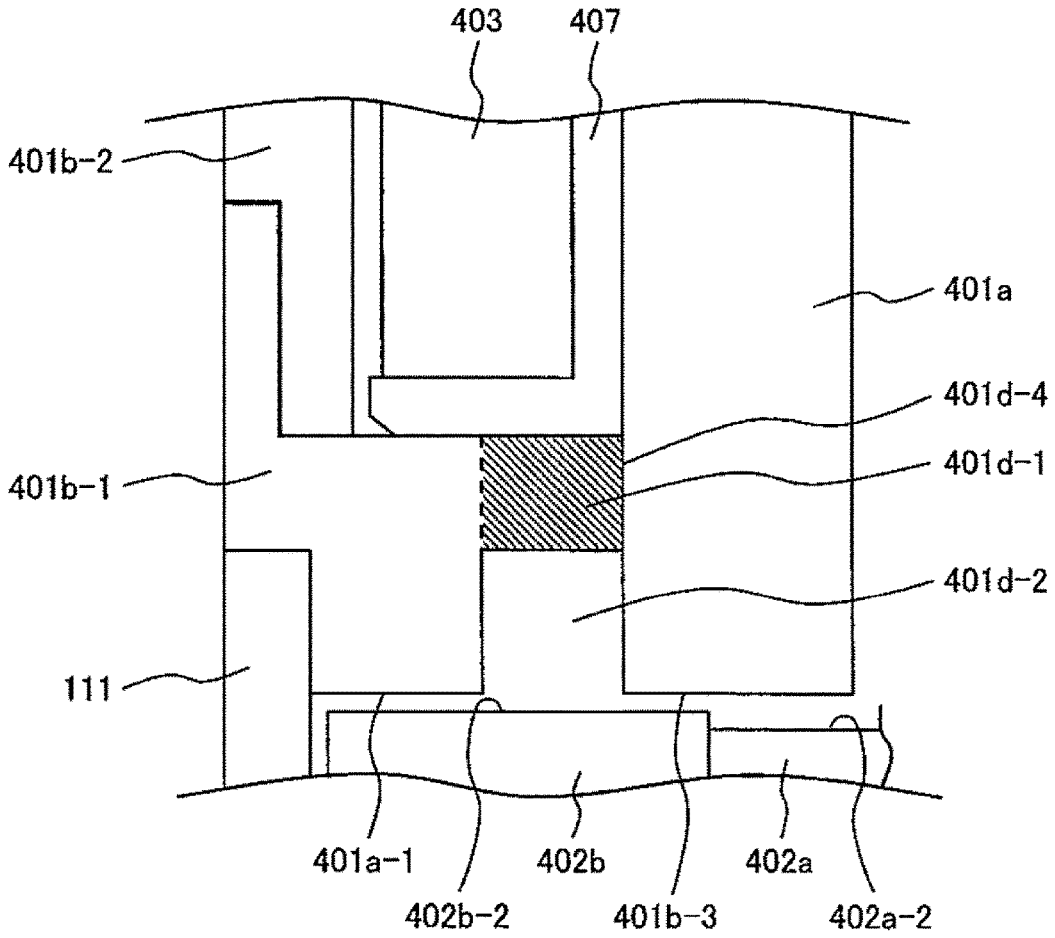

[Fig. 12]
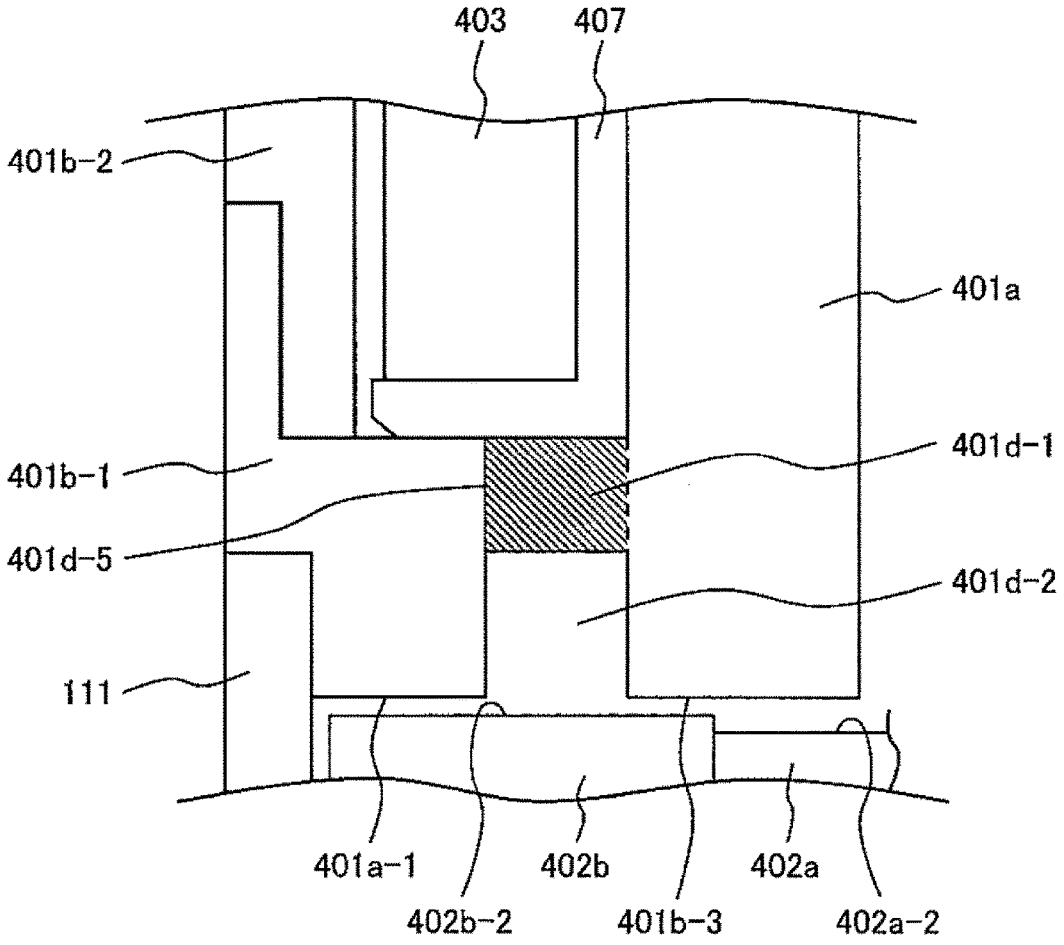

ELECTROMAGNETIC FUEL INJECTOR

TECHNICAL FIELD

The present invention relates to a fuel injector that supplies fuel to an internal combustion engine, and particularly, to a fuel injector that is driven by an electromagnetic force.

BACKGROUND ART

A background art of the technical field is disclosed in JP-A-2005-307750 (PTL 1). This publication discloses an electromagnetic fuel injector that includes a coil, a fixed core, a movable core, a fuel pipe, and a spring as parts of an electromagnetic drive unit. The fuel pipe has a large-diameter circular cylindrical portion and a small-diameter circular cylindrical portion, and the small-diameter circular cylindrical portion is provided at a lower end of the large-diameter circular cylindrical portion. The fixed core is mounted on an outer circumference of the small-diameter circular cylindrical portion, and the winding coil is mounted inside of the fixed core. The fixed core has an inner circumferential core portion and an outer circumferential core portion, an inner circumferential magnetic path is formed by the inner circumferential core portion, and an outer circumferential magnetic path is formed by the outer circumferential core portion. End surfaces of the inner circumferential magnetic path and the outer circumferential magnetic path face an end surface of the movable core. Magnetic fluxes generated by the energization of the coil flow between the end surface of the inner circumferential magnetic path and the end surface of the movable core, and between the end surface of the outer circumferential magnetic path and the end surface of the movable core, and a magnetic force (suction force) corresponding to a magnetic flux density is applied therebetween (refer to paragraphs 0034 and 0036).

A lower end portion of the small-diameter circular cylindrical portion of the fuel pipe extends toward a nozzle needle from the end surfaces of the inner circumferential magnetic path and the outer circumferential magnetic path. A cover is provided such that both axial end portions of the cover are respectively laser-welded to the entire outer circumference of the lower end portion of the small-diameter circular cylindrical portion and the entire outer circumference of the large-diameter circular cylindrical portion of the fuel pipe. The fixed core and the coil are accommodated in an inner space that is bounded by the cover and the fuel pipe, and fuel is prevented from infiltrating the fixed core and the coil (refer to paragraph 0040).

In regard to positions in which the cover is laser-welded to the outer circumference of the lower end portion of the small-diameter circular cylindrical portion, and the outer circumference of the large-diameter circular cylindrical portion, while deterioration in the magnetic characteristics of the fixed core induced by heat of fusion during welding is taken into consideration, the cover is joined to portions other than a movable core-side end surface of the fixed core, specifically, portions which are relatively separated from the movable core-side end surface of the fixed core, or a separate member (refer to paragraph 0050).

PTL 1 discloses an electromagnetic fuel injector that includes a cover made of a non-magnetic material which covers only the coil between an end surface of the inner circumferential magnetic path and an end surface of the outer circumferential magnetic path. This cover prevents fuel from infiltrating the coil. The cover is made thin, and may be made of a magnetic material, and when the cover is made of a magnetic material, the thickness of a bridge portion between the end surface of the inner circumferential magnetic path and the end surface of the outer circumferential magnetic path is set to be smaller than those of other portions (refer to paragraphs 0087 to 0089 and FIGS. 11 to 13).

CITATION LIST

Patent Literature

PTL 1: JP-A-2005-307750

SUMMARY OF INVENTION

Technical Problem

PTL 1 discloses the cover that covers the end surface of the inner circumferential magnetic path, the end surface of the outer circumferential magnetic path, and the coil between both of the end surfaces, and the cover that covers only the coil between the end surface of the inner circumferential magnetic path and the end surface of the outer circumferential magnetic path. In the former case, a portion of the cover, which covers the coil, is made of a non-magnetic material, and in the latter case, the cover is made of a non-magnetic material. These covers are provided so as to prevent fuel from infiltrating the fixed core or the coil, and PTL 1 merely discloses a configuration in which the cover is formed in the shape of a thin plate. In a design of the cover which covers only the coil between the end surface of the inner circumferential magnetic path and the end surface of the outer circumferential magnetic path, the fixation of the cover via welding is not taken into consideration.

In particular, when high pressurization of fuel is taken into consideration, the cover is preferably fixed via welding so that the cover can maintain sealability over a long period of time while counteracting fuel pressure. In a configuration disclosed in PTL 1, when the cover, which covers only the coil between the end surface of the inner circumferential magnetic path and the end surface of the outer circumferential magnetic path, is fixed via welding, welding need to be performed from the surface of the cover, which faces the movable core, with respect to an end surface of the inner circumferential core portion and an end surface of the outer circumferential core portion.

When welding is performed from the surface of the cover, which faces the movable core, with respect to the end surface of the inner circumferential core portion and the end surface of the outer circumferential core portion, sputters generated during welding, fusion-induced deformation, or heat-induced distortion are formed on the inner circumferential core portion, the outer circumferential core portion, and the movable core-side end surface of the cover. For this reason, a defect rate of the electromagnetic drive unit increases, a time or an workload required to perform an aftertreatment of removing sputter or deformation increases.

In a design of the electromagnetic fuel injector disclosed in PTL 1, deterioration in the magnetic characteristics of the fixed core induced by heat of fusion during welding is taken into consideration, and in contrast, deformation including distortion of the fixed core and the cover induced by heat of fusion is not taken into consideration.

Also in a case where treatments other than welding is performed, for example, a treatment of generating heat by applying energy to the cover is performed, when energy is applied to the end surface of the cover facing the movable core, the end surface of the cover facing the movable core is likely to be deformed (distorted). Hereinafter, the treatment (including welding) of generating heat by applying heat to a target member is referred to as a heat treatment.

In the following description, the fixed core and the movable core are respectively referred to as a fixed iron core and a movable iron core. Accordingly, the inner circumferential core portion and the outer circumferential core portion are respectively referred to as an inner circumferential fixed iron core portion and an outer circumferential fixed iron core portion.

In an electromagnetic fuel injector which is structured such that both end surfaces of an inner circumferential iron core portion and an outer circumferential iron core portion face a movable iron core, and a non-magnetic portion made of a metal material is provided between both end surfaces, an object of the present invention is to realize a structure in which a heat treatment is unlikely to affect the surface facing the movable iron core.

Solution to Problem

In an electromagnetic fuel injector of the present invention which is structured such that both end surfaces of an inner circumferential iron core portion and an outer circumferential iron core portion face a movable iron core, and a non-magnetic portion made of a metal material is provided between both end surfaces, in order to achieve this object, heat in a target member to be heat treated is generated by applying energy to a target member's surface which is different from a target member's surface that faces the movable iron core. More preferably, energy is applied to a surface different from a surface on a side that faces the movable iron core.

Advantageous Effects of Invention

According to the present invention, in an electromagnetic fuel injector which is structured such that both end surfaces of an inner circumferential iron core portion and an outer circumferential iron core portion face a movable iron core, and a non-magnetic portion made of a metal material is provided between both end surfaces, it is possible to realize a structure of the electromagnetic fuel injector in which a surface of a target member to be heat treated is unlikely to be affected by a heat treatment, with the surface facing the movable iron core.

A task, a configuration, and effects which have not been described above become apparent from embodiments to be described hereinafter.

BRIEF DESCRIPTION OF DRAWINGS

FIG. 1 is a longitudinal sectional view illustrating the structure of an electromagnetic fuel injector according to Embodiment 1 of the present invention.

FIG. 2 is an enlarged longitudinal sectional view illustrating an electromagnetic drive unit 4.

FIG. 3 is an enlarged longitudinal sectional view illustrating the vicinity of magnetic poles 401*a*-1 and 401*b*-3 illustrated by the dotted line circle in FIG. 2.

FIG. 4 is a longitudinal sectional view illustrating the configuration of an assembly of a fixed iron core 401.

FIG. 5 is a perspective view of a member used as a non-magnetic portion 401*d*.

FIG. 6 is a sectional view of the member used as the non-magnetic portion 401*d*, taken along line VI-VI in FIG. 5.

FIG. 7 illustrates an example in which the shape of the member used as the non-magnetic portion 401*d* is modified, and is an enlarged longitudinal sectional view illustrating the vicinity of the magnetic poles 401*a*-1 and 401*b*-3 illustrated by a dotted line circle A in FIG. 2.

FIG. 8 illustrates another example in which the shape of the member used as the non-magnetic portion 401*d* is modified, and is an enlarged longitudinal sectional view illustrating the vicinity of the magnetic poles 401*a*-1 and 401*b*-3 illustrated by the dotted line circle A in FIG. 2.

FIG. 9 illustrates still another example in which the shape of the member used as the non-magnetic portion 401*d* is modified, and is an enlarged longitudinal sectional view illustrating the vicinity of the magnetic poles 401*a*-1 and 401*b*-3 illustrated by the dotted line circle A in FIG. 2.

FIG. 10 illustrates Embodiment 2 of the present invention, and is an enlarged longitudinal sectional view illustrating the vicinity of the magnetic poles 401*a*-1 and 401*b*-3 illustrated by the dotted line circle A in FIG. 2.

FIG. 11 illustrates a modification example of Embodiment 2 of the present invention, and is an enlarged longitudinal sectional view illustrating the vicinity of the magnetic poles 401*a*-1 and 401*b*-3 illustrated by the dotted line circle A in FIG. 2.

FIG. 12 illustrates another modification example of Embodiment 2 of the present invention, and is an enlarged longitudinal sectional view illustrating the vicinity of the magnetic poles 401*a*-1 and 401*b*-3 illustrated by the dotted line circle A in FIG. 2.

DESCRIPTION OF EMBODIMENTS

Hereinafter, embodiments of the present invention will be described.

Embodiment 1

Embodiment 1 of the present invention will be described with reference to FIGS. 1 to 7.

The entire configuration of an electromagnetic fuel injector 1 will be described with reference to FIG. 1. FIG. 1 is a longitudinal sectional view illustrating the structure of the electromagnetic fuel injector according to the embodiments of the present invention.

The electromagnetic fuel injector 1 is configured to include a fuel supply unit 2 that supplies fuel; a valve unit 3 that allows or shut off a flow of fuel; and an electromagnetic drive unit 4 that drives the valve unit 3. In the embodiments, an electromagnetic fuel injector for an gasoline internal combustion engine will be exemplarily explained. In the electromagnetic fuel injector 1 of the embodiments, the fuel supply unit 2, the electromagnetic drive unit 4, and the valve unit 3 are sequentially disposed along a direction of a central axis 1*a*. The fuel supply unit 2 is attached to a fuel delivery pipe (not illustrated), and the valve unit 3 is attached in such a way as to face the inside of an intake manifold or a cylinder, both of which are not illustrated. Fuel of the electromagnetic fuel injector 1 flows from the fuel supply unit 2 to the valve unit 3 along substantially the direction of the central axis of the electromagnetic fuel injector 1. That is, a fuel passage inside the electromagnetic fuel injector 1 is formed along substantially the direction of the central axis 1*a* of the electromagnetic fuel injector 1. For this reason, a fuel passage 106 is formed by a through hole 105 that passes through the centers of a fuel pipe 201 and an inner circumferential fixed iron core 401*a* along the direction of the central axis. A through hole 402*a*-5, which is a fuel passage, is formed in a first movable iron core 402*a* in such a way as to face an opening of a through hole 150. A concave portion 101*a*-2, which is a fuel passage, and a communication hole 101*a*-3 are provided in a diameter expansion portion 101*a* of a plunger rod 101 in such a way as to face an opening of the through hole 402*a*-5, and the communication hole 101*a*-3 serves as a fuel passage through which an inner circumferential side of the concave portion 101*a*-2 communicates with an outer circumferential side of the diameter expansion portion 101*a*. A through hole 402*b*-8, which is a fuel passage, is provided in a bottom surface of a concave portion of a second movable iron core 402*b*, and the first movable iron core 402*a* is accommodated in the concave portion of the second movable iron core 402*b*. Accordingly, fuel sequentially flows through the fuel passage 106 of the fuel pipe 201, the through hole 402*a*-5, the concave portion 101*a*-2, the communication hole 101*a*-3, and the through hole 402*b*-8, and then flows to the fuel passage 106 inside a nozzle body 111.

The fuel supply unit 2 is formed by the fuel pipe 201 that extends from a first end portion of the inner circumferential fixed iron core 401*a* of the electromagnetic drive unit 4 (to be described later), and a fuel supply port 201*a* opens in an end portion of the fuel pipe 201. A diameter expansion portion 201*b* is provided in the vicinity of the fuel supply port 201*a* of the fuel pipe 201, and the diameter of the diameter expansion portion 201*b* is expanded such that a stepped portion is formed. An O-ring 202 is attached between the diameter expansion portion 201*b* and the fuel supply port 201*a*. Backup rings 203*a* and 203*b* are disposed in a stacked manner between the O-ring 202 and the diameter expansion portion 201*b*. The O-ring 202 works as a seal that prevents leakage of fuel when the fuel supply port 201*a* is attached to the fuel delivery pipe. The backup rings 203*a* and 203*b* back up the O-ring 202. A filter 204 is provided inside of the fuel supply port 201*a* so as to filter foreign matter mixed into fuel.

The valve unit 3 includes an injection hole formation member 301 in which a fuel injection hole 301*a* and a valve seat 301*b* are formed; a guide member 302 that is disposed inside the injection hole formation member 301; and a valve body 303 that is provided in one end portion (tip end) of the plunger rod 101. The injection hole formation member 301 is fitted to the inner circumferential surface 111*a* of a concave portion that is formed in a tip end portion of the nozzle body 111. The guide member 302 guides the one end portion of the plunger rod 101 such that the plunger rod 101 moves in the direction (valve opening and closing direction) of the central axis 1*a* of the electromagnetic fuel injector 1. During valve closing, the valve body 303 comes into contact with the valve seat 301*b*, and seals fuel along with the valve seat 301*b*. The guide member 302 is provided with a fuel passage 302*a* through which fuel on an upstream side of the guide member 302 is sent to a fuel passage portion that is formed between the valve body 303 and the valve seat 301*b*, seals fuel during valve closing, and allows a flow of fuel during valve opening. The valve unit 3 is a main part that injects fuel sprays, and serves as a spray formation portion that forms sprays.

The electromagnetic drive unit 4 includes a fixed iron core 401 that serves as an electromagnet generating an electromagnetic force; a movable iron core 402; a coil 403; a first spring member (spring) 404 that biases the movable iron core 402 in a valve closing direction; and a spring force adjustment member 405 that adjusts a spring force of the spring member 404. The valve body 303 is driven by the electromagnetic drive unit 4 such that the valve body 303 moves away from the valve seat 301 or comes into contact with the valve seat 301, that is, a valve opening and closing operation is performed. In the embodiments, the movable iron core 402 is configured to include the first movable iron core 402*a* and the second movable iron core 402*b*, and a second spring member (spring) 406 is provided to bias the movable iron core 402 in a valve opening direction.

The nozzle body 111 is a housing member that accommodates portions from the movable iron core 402 of the electromagnetic drive unit 401 to the valve unit 3.

Hereinafter, the electromagnetic drive unit 4 will be described in detail with reference to FIG. 2. FIG. 2 is an enlarged longitudinal sectional view illustrating the structure of the electromagnetic drive unit 4. FIG. 2 illustrates a state in which the coil is de-energized, and the valve is closed.

First, the configuration of the stator iron core 401 will be described in detail. The stator iron core 401 is configured to include the inner circumferential fixed iron core 401*a* that is provided on an inner circumferential side; the outer circumferential fixed iron core 401*b* that is provided on an outer circumferential side, while the coil 403 wound around a bobbin 407 is interposed between the inner circumferential fixed iron core 401*a* and the outer circumferential fixed iron core 401*b*; and an upper fixed iron core 401*c* that connects an end portion of the inner circumferential fixed iron core 401*a* to an end portion of the outer circumferential fixed iron core 401*b*. The outer circumferential fixed iron core 401*b* is an outer circumferential yoke portion (first yoke portion), the inner circumferential fixed iron core 401*a* is an inner circumferential yoke portion (second yoke portion), and the upper fixed iron core 401*c* is an upper yoke portion (third yoke portion).

An inner circumferential magnetic pole is formed on an end surface 401*a*-1 of the inner circumferential fixed iron core 401*a* which faces the movable iron core 402, and the inner circumferential magnetic path extends from the end surface 401*a*-1 toward the other end. The outer circumferential fixed iron core 401*b* is configured to include a first outer circumferential fixed iron core 401*b*-1 that faces the movable iron core portion 402, and a second outer circumferential fixed iron core 401*b*-2 that covers an outer circumference of the coil 403. An outer circumferential magnetic pole is formed on an end surface 401*b*-3 of the outer circumferential fixed iron core 401*b* which faces the movable iron core 402, and the outer circumferential magnetic pole extends from the end surface 401*b*-3 toward the other end. The upper fixed iron core 401*c* forms an upper (bridge portion) magnetic path.

A non-magnetic portion 401*d* is provided between an end portion 401*a*-2 and an end portion 401*b*-4, the end surface 401*a*-1 of the inner circumferential fixed iron core 401*a* is formed, and the end surface 401*b*-3 of the outer circumferential fixed iron core 401*b* is formed. The non-magnetic portion 401*d* is provided so as to reduce magnetic fluxes (leakage of magnetic fluxes) flowing without passing through the movable element 402 by disconnecting the end portion (in which the end surface 401*a*-1 of the inner circumferential fixed iron core 401*a* is formed) from the end portion (in which the end surface 401*b*-3 of the outer circumferential fixed iron core 401*b* is formed). In the embodiments, each of the inner circumferential fixed iron core 401*a* and the outer circumferential fixed iron core 401*b* is made of a metal material with magnetism, and a member made of a non-magnetic metal material is used as the non-magnetic portion 401*d*.

The configuration of the movable iron core portion 402 will be described in detail. The movable iron core portion 402 is configured to include the first movable iron core 402*a* and the second movable iron core 402*b*.

A concave portion 402*b*-1 is formed in an upper end surface (which faces the fixed iron core 401) 402*b*-2 of the second movable iron core 402*b* in such a way as to be recessed toward the other end surface (lower surface) of the second movable fixed iron core 402*b*. The first movable iron core 402*a* is accommodated in the concave portion 402*b*-1.

An outer circumferential portion of an upper end surface 402*a*-2 of the first movable iron core 402*a* faces the end surface 401*a*-1 of the inner circumferential fixed iron core 401*a*, and a lower end portion of the first spring member 404 is in contact with a central (inner circumferential) portion of the first movable iron core 402*a*. That is, a magnetic path, through which magnetic fluxes pass, is formed in the outer circumferential portion of the upper end surface 402*a*-2, and the inner circumferential portion serves as a spring seat for the first spring member 404. The first movable iron core 402*a* is biased in the valve closing direction by the first spring member 404. The first movable iron core 402*a* is provided with a concave portion 402*a*-3 that is recessed toward the upper end surface 402*a*-2 from the end surface (lower end surface) that is opposite to the upper end surface 402*a*-2, and the diameter expansion portion 101*a* of an upper end portion of the plunger rod 101 is inserted into the concave portion 402*a*-3. The first movable iron core 402*a* and the diameter expansion portion 101*a* of the plunger rod 101 are not fixed together, and can move relative to each other in the direction (valve opening and closing direction) of the central axis 1*a*. The outer circumferential surface of the diameter expansion portion 101*a* slides against the inner circumferential surface of the concave portion 402*a*-3 of the first movable iron core 402*a*, and the movement of the plunger rod 101 (the valve body 303) in the valve opening and closing direction is guided by the inner circumferential surface of the concave portion 402*a*-3.

A disk-shaped portion 402*b*-5 is formed in the second movable iron core 402*b*, and the upper end surface 402*b*-2 formed in the disk-shaped portion 402*b*-5 faces the end surface 401*a*-1 of the inner circumferential fixed iron core 401*a* and the end surface 401*b*-3 of the outer circumferential fixed iron core 401*b*. An upper end of the second spring member 406 is in contact with an end surface (lower end surface) 402*b*-3 opposite to the upper end surface 402*b*-2 of the second movable iron core 402*b*. A lower end of the second spring member 406 is in contact with a lower end surface (bottom surface) 111*b* of an accommodation chamber that is formed in the nozzle body 111 so as to accommodate the movable iron core 402 and the second spring member 406. That is, the lower end surface 111*b* of the accommodation chamber serves as a spring seat for the second spring member 406. The lower end surface 111*b* of the accommodation chamber faces the lower end surface 402*b*-3 of the second movable iron core 402*b*. The second movable iron core 402*b* is biased in the valve opening direction by the second spring member 406.

A convex portion 402*b*-5 is formed in an annular shape on the circumference of a small-diameter portion of the second movable iron core 402*b* which is positioned below the disk-shaped portion 402*b*-4. The convex portion 402*b*-5 is in contact with an inner circumferential surface 111*c* of the nozzle body 111, and the movement of the second movable iron core 402*b* in the direction of the central axis 1*a* is guided by the inner circumferential surface 111*c*. That is, the inner circumferential surface 111*c* serves as a guide surface that guides the movement of the second movable iron core 402*b* in the valve opening and closing direction. An outer circumferential surface 402*a*-1 of the first movable iron core 402*a* is in contact with an inner circumferential surface 402*b*-6 of the concave portion 402*b*-1 of the second movable iron core 402*b*, and the movement of the first movable iron core 402*a* in the direction of the central axis 1*a* is guided by the inner circumferential surface 402*b*-6. That is, the inner circumferential surface 402*b*-6 serves as a guide surface that guides the movement of the first movable iron core 402*a* in the valve opening and closing direction. The first movable iron core 402*a* and the second movable iron core 402*b* are configured to be able to move relative to each other in the direction of the central axis 1*a*, and the inner circumferential surface 111*c* guides the first movable iron core 402*a* via the second movable iron core 402*b*.

In a valve closed state (valve closed and stop state) illustrated in FIG. 2, there is a gap $g_1$ present between the upper end surface 402*a*-2 of the first movable iron core 402*a* and the end surface 401*a*-1 of the inner circumferential fixed iron core 401*a*. There is a gap $g_2$ present between the upper end surface 402*b*-2 of the second movable iron core 402*b* and the end surface 401*a*-1 of the inner circumferential fixed iron core 401*a*, and between the upper end surface 402*b*-2 of the second movable iron core 402*b* and the end surface 401*b*-3 of the outer circumferential fixed iron core 401*b*. The size of the gap $g_1$ is set to be greater than that of the gap $g_2$. The first movable iron core 402*a* is biased in the valve closing direction by the first spring member 404, and the first movable iron core 402*a* is stopped in a state where the bottom surface of the concave portion 402*a*-3 is in contact with an upper end surface of the diameter expansion portion 101*a* of the plunger rod 101. Since a lower end surface 402*a*-4 of the first movable iron core 402*a* is in contact with a bottom surface 402*b*-7 of the second movable iron core 402*b*, the second movable iron core 402*b*, which is biased in the valve opening direction by the second spring member 406, is pushed in the valve closing direction by the first movable iron core 402*a*. Accordingly, there is a gap $g_3$ present between a lower end surface 101*a*-1 of the diameter expansion portion 101*a* of the plunger rod 101 and the bottom surface 402*b*-7 of the second movable iron core 402*b*. The size of the gap $g_3$ is set to be less than that of the gap $g_2$. The gap $g_1$ is designed into the valve so as to obtain a preliminary stroke.

The configuration of magnetic paths of the electromagnetic drive unit 4 and a valve opening and closing operation of the electromagnetic fuel injector 1 will be described with reference to FIG. 2. When the coil 403 is energized in the valve closed state (the state illustrated in FIG. 2), generated magnetic fluxes flow through an annular magnetic path B that is formed in the inner circumferential fixed iron core 401*a*, the movable iron core 402, the outer circumferential fixed iron core 401*b*, the first outer circumferential fixed iron core portion 401*b*-1, the second outer circumferential fixed iron core portion 401*b*-2, and the upper fixed iron core 401*c*. In this case, a magnetic path Ba is formed such that magnetic fluxes flow from the inner circumferential fixed iron core 401*a* to the second movable iron core 402*b* via the first movable iron core 402*a*, and a magnetic path Bb is formed such that magnetic fluxes flow directly to the second movable iron core 402*b* from the inner circumferential fixed iron core 401*a* without passing through the first movable iron core 402*a*.

The end surface 401*a*-1 of the inner circumferential fixed iron core 401*a* and the end surface 401*b*-3 of the outer circumferential fixed iron core 401*b* form magnetic poles, respectively, and suction the first movable iron core 402*a* and the second movable iron core 402*b*.

The flow direction of magnetic fluxes through the magnetic path B can be opposite to a direction of the arrow in FIG. 2.

When the coil 403 is energized, and magnetic fluxes are generated on the magnetic path B, the first movable iron core 402*a* is suctioned by the magnetic pole 401*a*-1 such that the first movable iron core 402*a* moves in the valve opening direction, and the second movable iron core 402*b* is suctioned by the magnetic poles 401*a*-1 and 401*b*-3 such that the second movable iron core 402*b* moves in the valve opening direction. When the second movable iron core 402*b* moves the gap (preliminary stroke) $g_3$, the bottom surface 402*b*-7 of the second movable iron core 402*b* comes into contact with the lower end surface 101*a*-1 of the diameter expansion portion 101*a* of the plunger rod 101. Due to this contact, the second movable iron core 402*b* and the plunger rod 101 integrally move in the valve opening direction. The plunger rod 101 is closed until the second movable iron core 402*b* comes into contact with the diameter expansion portion 101*a*, and after the second movable iron core 402*b* comes into contact with the diameter expansion portion 101*a*, the plunger rod 101 starts to open. Accordingly, the operation of the plunger rod 101 can be prevented from being affected by a delay time from when the coil starts to be energized to when the second movable iron core 402*b* receives a magnetic suction force, and starts to move.

When the upper end surface (suctioned surface) 402*a*-2 of the first movable iron core 402*a*, and the upper end surface (suctioned surface) 402*b*-2 of the second movable iron core 402*b* come into contact with the end surface 401*a*-1 of the inner circumferential fixed iron core 401*a* and the end surface 401*b*-3 of the outer circumferential fixed iron core 401*b*, a valve opening operation is completed, and the valve is brought into a valve open and stop state.

In the valve open and stop state, a fuel pressure is applied to the diameter expansion portion 101*a* of the plunger rod 101 such that the plunger rod 101 is biased in the valve closing direction, and thus the lower end surface 101*a*-1 of the diameter expansion portion 101*a* is in contact with the bottom surface 402*b*-7 of the second movable iron core 402*b*. For this reason, a gap equivalent to the gap $g_3$ is formed as a preliminary stroke between the bottom surface of the concave portion 402*a*-3 of the first movable iron core 402*a* and the upper end surface of the diameter expansion portion 101*a*. A gap ($g_1$-$g_2$) is formed between the lower end surface 402*a*-4 of the first movable iron core 402*a* and the bottom surface 402*b*-7 of the second movable iron core 402*b*.

A valve opening operation period refers to a period from when a magnetic suction force starts to be applied to the first movable iron core 402*a* and the second movable iron core 402*b* in the valve closed and stop state to when the first movable iron core 402*a* and the second movable iron core 402*b* move a full stroke such that the valve open and stop state is reached.

When the coil 403 is de-energized, a magnetic suction force decreases rapidly. At this time, the first movable iron core 402*a* is biased in the valve closing direction by the first biasing spring member 404, and thus when the magnetic suction force cannot counteract the biasing force of the first biasing spring member 404, the first movable iron core 402*a* starts to move in the valve closing direction. In contrast, since the second movable iron core 402*b* is biased in the valve opening direction by the second spring member 406, the second movable iron core 402*b* is stopped. Since the second spring member 406 biases the plunger rod 101 in the valve opening direction via the second movable iron core 402*b*, the plunger rod 101 is also stopped. When the first movable iron core 402*a* moves the gap ($g_1$-$g_2$) that is formed between the lower end surface 402*a*-4 of the first movable iron core 402*a* and the bottom surface 402*b*-7 of the second movable iron core 402*b*, the lower end surface 402*a*-4 of the first movable iron core 402*a* comes into contact with the bottom surface 402*b*-7 of the second movable iron core 402*b*, and the first movable iron core 402*a* and the second movable iron core 402*b* integrally move in the valve closing direction. Accordingly, the plunger rod 101 also moves in the valve closing direction.

When the valve body 303 comes into contact with the valve seat 301*b*, the plunger rod 101 stops moving in the valve closing direction. At this time, the plunger rod 101 may rebound to some extent. When the plunger rod 101 stops moving in the valve closing direction, the bottom surface of the concave portion 402*a*-3 of the first movable iron core 402*a* comes into contact with the upper end surface of the diameter expansion portion 101*a* of the plunger rod 101, and the first movable iron core 402*a* and the plunger rod 101 are integrated together. Even after the plunger rod 101 stops moving in the valve closing direction, due to an inertia force, the second movable iron core 402*b* moves away from the first movable iron core 402*a*, and continuously moves in the valve closing direction. When the second movable iron core 402*b* moves to some extent in the valve closing direction, the inertia force is attenuated by the biasing force of the second spring member 406, and the second movable iron core 402*b* stops moving. Thereafter, the second movable iron core 402*b* is pushed in the valve opening direction by the biasing force of the second spring member 406, the bottom surface 402*b*-7 of the second movable iron core 402*b* comes into contact with the lower end surface 402*a*-4 of the first movable iron core 402*a*, and a valve closing operation is completed in a state where the first movable iron core 402*a* and the second movable iron core 402*b* are integrated together. A valve closing operation period refers to a period from when the coil 403 is de-energized to when the valve closing operation is completed, and the valve closed and stop state is reached.

During valve closing, particularly, when the valve body 303 sits on the valve seat, since the second movable iron core 402*b* moves away from the first movable iron core 402*a*, mass of a movable element is decreased. As a result, the valve body 303 (the plunger rod 101) can be prevented from rebounding.

Hereinafter, a method of assembling the non-magnetic portion 401*d* of the fixed iron core 401 into the electromagnetic drive unit 4 will be described with reference to FIGS. 3 and 4. FIG. 3 is an enlarged longitudinal sectional view illustrating the vicinity of the magnetic poles 401*a*-1 and 401*b*-3 illustrated by the dotted line circle A in FIG. 2. FIG. 4 is a longitudinal sectional view illustrating the configuration of an assembly of the fixed iron core 401.

The non-magnetic portion 401*d* is provided between the end portion 401*a*-2 (in which the end surface 401*a*-1 of the inner circumferential fixed iron core 401*a* is formed) and the end portion 401*b*-4 (in which the end surface 401*b*-3 of the outer circumferential fixed iron core 401*b* is formed). An annular member is used as the non-magnetic portion 401*d*, and an annular concave portion 401*d*-1 is circumferentially formed in an outer circumferential surface of the non-magnetic portion 401*d*. A bottom portion of the annular concave portion 401*d*-1 is welded all around as illustrated by W1, and thus the annular concave portion 401*d*-1 is fixed to the inner circumferential fixed iron core 401*a*, and a gap between the inner circumferential surface of the non-magnetic portion 401*d* and the outer circumferential surface of the inner circumferential fixed iron core 401*a* is sealed. In addition, all around welding is performed at a position illustrated by W1 such that the first outer circumferential fixed iron core portion 401*b*-1 and the non-magnetic portion 401*d* are fixed together, and a gap between the outer circumferential surface of the non-magnetic portion 401*d* and the inner circumferential surface of the first outer circumferential fixed iron core portion 401*b*-1 is sealed.

All around welding illustrated by W1 is performed in a state where the non-magnetic portion 401*d* is assembled to the outer circumferential surface of the inner circumferential fixed iron core 401*a*. At this time, the coil 403 wound around the bobbin 407, the outer circumferential fixed iron core 401*b*, the upper fixed iron core 401*c*, and the nozzle body 111 have not yet been assembled. Accordingly, it is possible to perform welding by applying energy for welding from the outside of the outer circumferential surface of the non-magnetic portion 401*d*. Laser welding or the like can be used as a welding method. During laser welding, laser beams are irradiated to the bottom surface of the concave portion 401*d*-1 from the outside of the outer circumferential surface of the non-magnetic portion 401*d*. The non-magnetic portion 401*d* may be welded all around to the inner circumferential fixed iron core 401*a* in a state where the non-magnetic portion 401*d* is assembled to the inner circumferential fixed iron core 401*a* via press fitting.

All around welding illustrated by W2 is performed in a state where the first outer circumferential fixed iron core portion 401*b*-1 is assembled to an assembly of the inner circumferential fixed iron core 401*a* and the non-magnetic portion 401*d*. At this time, the coil 403 wound around the bobbin 407, the second outer circumferential fixed iron core portion 401*b*-2, the upper fixed iron core 401*c*, and the nozzle body 111 have not yet been assembled. Accordingly, it is possible to perform welding by applying energy for welding to surfaces of the non-magnetic portion 401*d* and the first outer circumferential fixed iron core portion 401*b*-1, with the surfaces opposite to the end surface 401*b*-3 that faces the movable iron core 402. Laser welding or the like can be used as a welding method. During laser welding, the surfaces of the non-magnetic portion 401*d* and the first outer circumferential fixed iron core portion 401*b*-1 are irradiated with laser beams from the outside of the surfaces thereof, with the surfaces opposite to the end surface 401*b*-3 that faces the movable iron core 402. The all around welding W2 may be performed in a state where the first outer circumferential fixed iron core portion 401*b*-1 and the non-magnetic portion 401*d* are assembled together via press fitting.

Since the second outer circumferential fixed iron core portion 401*b*-2 has not yet been assembled when the all around welding W2 is performed, it is easy to apply energy to a welded portion, and for example, during laser welding, a welded portion is easily irradiated with laser beams. A thin wall portion 401*b*-1*a* for the attachment of the second outer circumferential fixed iron core portion 401*b*-2 is provided in an upper end portion of the first outer circumferential fixed iron core portion 401*b*-1. In order for a welded portion to be easily irradiated with laser beams, preferably, accuracy in fixing the second outer circumferential fixed iron core portion 401*b*-2 and rigidity of the thin wall portion 401*b*-1*a* are ensured, and a height h of the thin wall portion 401*b*-1*a* is decreased.

In the embodiments, it is possible to perform the welding W1 and the welding W2 by applying energy the surface of the fixed iron core 401, which is different from the end surface (the end surface 401*b*-3 of the first outer circumferential fixed iron core portion 401*b*-1, and the end surface 401*a*-1 of the inner circumferential fixed iron core portion 401*a*) that faces the movable iron core 402. For this reason, it is possible to prevent or suppress the occurrence of distortion or deformation of the end surface of the fixed iron core 401 which faces the movable iron core 402. Sputters generated during welding can be prevented from adhering to the end surface of the fixed iron core 401 which faces the movable iron core 402. In addition, since the welding W1 can be performed in a direction perpendicular to the outer circumferential surfaces of the non-magnetic portion 401*d* and the inner circumferential fixed iron core 401*a*, reliability of the welded portion is improved.

Hereinafter, the configuration of a member used as the non-magnetic portion 401*d* of the embodiments will be described with reference to FIGS. 5 and 6. FIG. 5 is a perspective view of a member used as the non-magnetic portion 401*d*. FIG. 6 is a sectional view of the member used as the non-magnetic portion 401*d*, taken along line VI-VI in FIG. 5.

In FIG. 3, a surface 401*d*-6, 401*d*-7 of the member used as the non-magnetic portion 401*d* is in contact with the inner circumferential surface of the first outer circumferential fixed iron core 401*b*-1. Accordingly, the member used as the non-magnetic portion 401*d* supports the first outer circumferential fixed iron core 401*b*-1 in the direction of the central axis 1*a* to greater extent, and during assembly, the first outer circumferential fixed iron core 401*b*-1 is unlikely to be inclined.

In contrast, when the first outer circumferential fixed iron core 401*b*-1 is press-fitted and fixed to the member used as the non-magnetic portion 401*d*, a press-fit load is increased. As illustrated in FIG. 6, the height of a surface 401*d*-7 is decreased by S3 from that of the surface 401*d*-6 such that the surface 401*d*-7 is not in contact with the inner circumferential surface of the first outer circumferential fixed iron core 401*b*-1. At this time, it is necessary to bring the surface 401*d*-6 into contact with the inner circumferential surface of the first outer circumferential fixed iron core 401*b*-1 so as to perform the welding W2 on the surface 401*d*-6. A length S1 of the surface 401*d*-6 is set to be greater than a length S2 of the surface 401*d*-7 in the direction of the central axis 1*a* so as to support the first outer circumferential fixed iron core 401*b*-1 in the direction of the central axis 1*a* to greater extent. Accordingly, it is possible to prevent an excessive increase in press-fit load.

As illustrated by the dotted line in FIG. 6, the height of the surface 401*d*-7 may be set to be the same as that of the bottom surface of the annular concave portion 401*d*-1 such that the bottom surface of the annular concave portion 401*d*-1 and the surface 401*d*-7 are formed as a single surface.

The second outer circumferential fixed iron core portion 401*b*-2 is assembled to an assembly of the inner circumferential fixed iron core 401*a*, the non-magnetic portion 401*d*, and the first outer circumferential fixed iron core portion 401*b*-1 which are assembled via the welding W1 and the welding W2. This assembly is performed via press fitting. The thin wall portions 401*b*-1*a* and 401*b*-2*a* are respectively provided in fitting portions of the first outer circumferential fixed iron core portion 401*b*-1 and the second outer circumferential fixed iron core portion 401*b*-2. Welding W3 is performed by applying energy to the outer circumferential surface of the thin wall portion 401*b*-1*a* such that the thin wall portion 401*b*-1*a* is fixed to the thin wall portion 401*b*-2*a*. Laser welding or the like can be used as a welding method. Since sealability is not required for the welding W3, all around welding is not required to be performed, and spot welding may be performed as the welding W3.

An assembly 150 of the inner circumferential fixed iron core 401*a*, the non-magnetic portion 401*d*, the first outer circumferential fixed iron core portion 401*b*-1, and the second outer circumferential fixed iron core portion 401*b*-2 is built via the aforementioned welding process. A longitudinal sectional view of the assembly 150 is illustrated in FIG. 4. The inner circumferential fixed iron core 401*a* and the fuel pipe 201 are integrally formed as a single member. The central axial through hole 105 is substantially linearly formed at the center of this single member along the direction of the central axis 1*a* from the fuel supply port 201*a* to the opening that is formed in the end surface of the inner circumferential fixed iron core 401*a* which faces the movable iron core 402. The central axial through hole 105 is used as a fuel passage, and works as an accommodation space that accommodates the first spring member 404 and the spring force adjustment member 405. At this point of time, the upper fixed iron core 401*c* has not yet been assembled, and an accommodation space 401*e* which accommodates the coil 403 is formed between the outer circumferential surface of the inner circumferential fixed iron core 401*a* and the inner circumferential surface of the second outer circumferential fixed iron core portion 401*b*-2.

The coil 403 wound around the bobbin 407 is mounted in the accommodation space 401*e* of the assembly 150, and thereafter, the upper fixed iron core 401*c* is attached to an upper opening of the accommodation space 401*e*. The upper fixed iron core 401*c* is press-fitted to the outer circumferential surface of the inner circumferential fixed iron core 401*a*, and welding W4 is performed by applying energy from the outside of the outer circumferential surface of the outer circumferential fixed iron core portion 401*b*-2. Laser welding or the like can be used as a welding method. All around welding cannot be performed due to wirings of terminals 119, which is not a problem because sealability is not required for the welding W4. Spot welding may be performed as the welding W4. As a result, the upper fixed iron core 401*c* is fixed to the outer circumferential fixed iron core portion 401*b*-2. Welding W5 is performed on the upper surface of the upper fixed iron core 401*c*, and thus the upper fixed iron core 401*c* is fixed to the inner circumferential fixed iron core 401*a*. Since sealability is not required for the welding W5, spot welding may be used as the welding W5.

The terminals 119, which are electrically connected to the coil 403, lead from the upper fixed iron core 401*c*. Resin molding 120 is applied to the surroundings of the coil 403 in the accommodation space 401*e* (refer to FIG. 4), and the surroundings of the terminals 119 which are disposed above the upper fixed iron core 401*c*. A connector 120*a* is formed around the terminals 119 by the resin molding 120.

A fixed iron core 401-side assembly has been built, the movable element made up of the movable iron core 402 and the plunger rod 101, and the second spring member 406 are accommodated in an accommodation space 111*d* of the nozzle body 111, and the nozzle body 111 is fixed to the fixed iron core 401-side assembly. This fixing is done by all around welding W6 that is performed by applying energy from the outside of an upper end portion 111*e* of the nozzle body 111. Laser welding or the like can be used as a welding method. At this time, the injection hole formation member 301 and the guide member 302 may be in a state of being attached to the nozzle body 111, or after the nozzle body 111 is assembled to the fixed iron core 401-side assembly, the injection hole formation member 301 and the guide member 302 may be assembled to the nozzle body 111. It is necessary to adjust a stroke of the valve body 303 (the plunger rod 101), and depending on a stroke adjustment method, it is possible to change an assembly sequence in which the injection hole formation member 301 and the guide member 302 are assembled to the nozzle body 111. A description of the stroke adjustment will be omitted.

Examples, in which the shape of the member used as the non-magnetic portion 401*d* is modified, will be described with reference to FIGS. 7 to 9. Similar to FIG. 3, FIGS. 7 to 9 are enlarged longitudinal sectional views illustrating the vicinity of the magnetic poles 401*a*-1 and 401*b*-3 illustrated by the dotted line circle in FIG. 2.

The member used as the non-magnetic portion 401*d* may have a shape illustrated in FIG. 7. That is, the member used as the non-magnetic portion 401*d* has a wedge-shaped section in a sectional plane (longitudinal sectional) plane that includes the central axis 1*a* and is parallel to the central axis 1*a*. In this wedge shape, the width of a surface of the non-magnetic portion 401*d*, which faces the movable iron core 402, is larger than that of the opposite surface (which faces the coil 403) of the non-magnetic portion 401*d*. A fuel pressure is applied from the surface (which faces the movable iron core 402) of the member used as the non-magnetic portion 401*d* toward the coil 403. Since the non-magnetic portion 401*d* is formed in a wedge shape, the fuel pressure acts to increase sealability of the member used as the non-magnetic portion 401*d*. Accordingly, it is possible to increase reliability of sealing of the member used as the non-magnetic portion 401*d* by forming the member used as the non-magnetic portion 401*d* in the shape illustrated in FIG. 5.

Also in this example, the welding portion W1 between the non-magnetic portion 401*d* and the inner circumferential fixed iron core 401*a*, the welding portion W2 between the non-magnetic portion 401*d* and the first outer circumferential fixed iron core portion 401*b*-1 are performed by applying energy (irradiation of laser beams) to the surface that is different from the surface of the non-magnetic portion 401*d* which faces the movable iron core 402. In particular, in this example, it is possible to perform the welding W1 and the welding W2 at two locations on the surface opposite to the surface that faces the movable iron core 402. For this reason, after the member used as the non-magnetic portion 401*d* is assembled to the first outer circumferential fixed iron core portion 401*b*-1 before being assembled to the inner circumferential fixed iron core 401*a*, the member used as the non-magnetic portion 401*d* can also be assembled to the inner circumferential fixed iron core 401*a*.

The longitudinal section of the member used as the non-magnetic portion 401*d* may have a rectangular (or square) shape illustrated in FIG. 8 instead of a wedge shape. That is, the member used as the non-magnetic portion 401*d* is formed in a simple circular cylindrical shape. The length of contact between the non-magnetic portion 401*d* and the inner circumferential fixed iron core 401*a*, and between the non-magnetic portion 401*d* and the first outer circumferential fixed iron core 401*b*-1 in the direction of the central axis 1*a* is preferably increased so as to prevent the non-magnetic portion 401*d* from being inclined relative to the central axis 1*a*. Preferably, the radial length of the end surface 401*b*-3 of the first outer circumferential fixed iron core portion 401*b*-1 and the radial length of the end surface 401*a*-1 of the inner circumferential fixed iron core 401*a* are increased such that the area of each of a magnetic pole surface is increased, with the end surface 401*b*-3 and the end surface 401*a*-1 facing the movable iron core 402. For this reason, the longitudinal section of the member used as the non-magnetic portion 401*d* preferably has a rectangular shape rather than a square shape. The welding W1 and the welding W2 are performed in the same shape illustrated in FIG. 7.

The longitudinal section of the member used as the non-magnetic portion 401*d* may have a shape bent at 90 degrees (right angle) as illustrated in FIG. 9. That is, the member used as the non-magnetic portion 401*d* is shaped to have a circular cylindrical portion and an annular disk-shaped portion (flange portion) that is connected to an upper end of the circular cylindrical portion. Also in this example, it is possible to perform the welding W1 and the welding W2 on a surface opposite to a surface that faces the movable iron core 402. In this example, the non-magnetic portion 401*d* has the flange portion, and thus accuracy in a welding position when the welding W2 is performed is less strict than that in the cases in which the non-magnetic portion 401*d* has the shape illustrated in any one of FIGS. 3, 7, and 8.

Embodiment 2

Embodiment 2 of the present invention will be described with reference to FIGS. 10 to 12.

Similar to FIG. 3, FIGS. 10 to 12 are enlarged longitudinal sectional views illustrating the vicinity of the magnetic poles 401*a*-1 and 401*b*-3 illustrated by the dotted line circle in FIG. 2.

First, a configuration illustrated in FIG. 10 will be described. In the embodiment, the configuration illustrated in FIG. 10 is a basic configuration.

In the embodiment, the inner circumferential fixed iron core 401*a* and the first outer circumferential fixed iron core portion 401*b*-1 are formed as a single component (single member) in which the inner circumferential fixed iron core 401*a* and the first outer circumferential fixed iron core portion 401*b*-1 are connected to each other via a non-magnetic region 401*d*-2. Typically, the non-magnetic region 401*d*-1 is made of a magnetic material; however, the non-magnetic region 401*d*-1 is brought into a state of being not magnetized via a non-magnetization process such as a heat treatment. A void 401*d*-2 is formed in a surface of the non-magnetic region 401*d*-1 which faces the movable iron core 402, and the non-magnetic portion 401*d* is configured to include the void 401*d*-2 and the non-magnetic region 401*d*-1. The void 401*d*-2 is an annular concave portion (groove) that is formed between the end surface 401*a*-1 of the inner circumferential fixed iron core 401*a* and the end surface 401*b*-3 of the first outer circumferential fixed iron core portion 401*b*-1.

In the embodiment, welding is not required; however, a non-magnetization process such as a heat treatment is required to form the non-magnetic region 401*d*-1. During a non-magnetization process, a surface (opposite to the surface that faces the movable iron core 402) of the non-magnetic region 401*d*-1 is irradiated with laser beams such that energy for a heat treatment is applied thereto. Even if the irradiated surface is distorted due to the irradiation of laser beams, since the distorted irradiated surface is opposite to the surface that faces the movable iron core 402, the surface facing the movable iron core 402 can be less affected.

In the embodiment, it is possible to reduce the number of components, and it is possible to reduce an assembly time by reducing a time required to align the positions of the components. In the embodiment, the inner circumferential fixed iron core 401*a*, the non-magnetic region 401*d*-1, and the first outer circumferential fixed iron core portion 401*b*-1 are formed as a single component, and thus sealability of this region is ensured.

As illustrated in FIGS. 11 and 12, the inner circumferential fixed iron core 401*a*, the non-magnetic region 401*d*-1, and the first outer circumferential fixed iron core portion 401*b*-1 can also be formed as two components. In a configuration illustrated in FIG. 11, the non-magnetic region 401*d*-1 is formed in the first outer circumferential fixed iron core portion 401*b*-1, and thus the non-magnetic region 401*d*-1 and the first outer circumferential fixed iron core portion 401*b*-1 are formed as a single component. A joining surface 401*d*-4, which is joined to the inner circumferential fixed iron core 401*a*, is formed in an end portion of the non-magnetic region 401*d*-1 which faces the inner circumferential fixed iron core 401*a*. It is possible to ensure sealability by performing the all around welding W1 at one location on the joining portion between the non-magnetic region 401*d*-1 and the inner circumferential fixed iron core portion 401*a*. When the welding W1 is performed, the surface, which is opposite to the surface (which faces the movable iron core 402) of the non-magnetic region 401*d*-1 and the inner circumferential fixed iron core portion 401*a*, is irradiated with laser beams such that energy for welding is applied to thereto. Even if the irradiated surface is distorted due to the irradiation of laser beams, since the distorted irradiated surface is opposite to the surface that faces the movable iron core 402, the surface facing the movable iron core 402 can be less affected. The welding W1 may be performed in a state where the non-magnetic region 401*d*-1 and the inner circumferential fixed iron core portion 401*a* are assembled together via press fitting.

In contrast, in a configuration illustrated in FIG. 12, the non-magnetic region 401*d*-1 is formed in the inner circumferential fixed iron core 401*a*, and thus the non-magnetic region 401*d*-1 and the inner circumferential fixed iron core 401*a* are formed as a single component. A joining surface 401*d*-5, which is joined to the first outer circumferential fixed iron core portion 401*b*-1, is formed in an end portion of the non-magnetic region 401*d*-1 which faces the first outer circumferential fixed iron core portion 401*b*-1. For this reason, it is possible to ensure sealability by performing the all around welding W2 at one location on the joining portion between the non-magnetic region 401*d*-1 and the first outer circumferential fixed iron core portion 401*b*-1. When the welding W2 is performed, the surface, which is opposite to the surface (which faces the movable iron core 402) of the non-magnetic region 401*d*-1 and the first outer circumferential fixed iron core portion 401*b*-1, is irradiated with laser beams such that energy for welding is applied to thereto. Even if the irradiated surface is distorted due to the irradiation of laser beams, since the distorted irradiated surface is opposite to the surface that faces the movable iron core 402, the surface facing the movable iron core 402 can be less affected. The welding W2 may be performed in a state where the non-magnetic region 401*d*-1 and the first outer circumferential fixed iron core portion 401*b*-1 are assembled together via press fitting.

In the configurations illustrated in FIGS. 11 and 12, the number of components is increased compared to the configuration illustrated in FIG. 10; however, the number of components can be reduced by one count compared to that in Embodiment 1.

Hereinafter, characteristics which are common to Embodiments 1 and 2 will be described with reference to FIGS. 2 and 3. The description will be given on the condition that the non-magnetic portion 401 is a portion of the fixed iron core 401.

In Embodiments 1 and 2, energy for welding or a non-magnetization process is applied to the surface (referred to as a second surface) of the stator iron core 401 which is opposite to the surface (referred to as a first surface) that faces the movable iron core 402. For this reason, the first surface is not affected or is unlikely to be affected by distortion or deformation that is formed on the second surface. When welding or a non-magnetization process is performed by irradiating a target object with laser beams, the second surface is irradiated with laser beams. Hereinafter, laser welding or a non-magnetization process using laser beams will be described.

When the second surface is irradiated with laser beams, an irradiated portion irradiated with laser beams is positioned at the bottom of an annular concave portion that is surrounded between the inner circumferential fixed iron core 401*a* and the outer circumferential fixed iron core 401*b*. For this reason, the outer circumferential fixed iron core 401*b* is partitioned into two components (the first outer circumferential fixed iron core 401*b*-1 and the second outer circumferential fixed iron core 401*b*-2). The location of partitioning of the outer circumferential fixed iron core 401*b* into the first outer circumferential fixed iron core 401*b*-1 and the second outer circumferential fixed iron core 401*b*-2 is positioned lower (closer to the end surface 401*b*-3) than an upper end portion 403 of a winding portion of the coil 403. A welding joining location W3 between the first outer circumferential fixed iron core 401*b*-1 and the second outer circumferential fixed iron core 401*b*-2 is positioned lower than the upper end portion 403 of the winding portion of the coil 403.

The outer circumferential surface of the second outer circumferential fixed iron core 401*b*-2 forms the outer circumferential surface of a metal housing which is positioned in an uppermost portion of the electromagnetic drive unit 4, and the outer circumferential surface of the first outer circumferential fixed iron core 401*b*-1 forms the outer circumferential surface of the metal housing which is positioned therebelow.

The outer circumferential surface of the nozzle body 111 forms the outer circumferential surface of a metal housing that surrounds an outer circumference of the movable iron core 402 of the electromagnetic drive unit 4. In order to assemble the movable iron core 402, the second spring member 406, and the plunger rod 101, the nozzle body 111 has to be partitioned from the outer circumferential surface of the metal housing which are formed by the outer circumferential surfaces of the second outer circumferential fixed iron core 401*b*-2 and the first outer circumferential fixed iron core 401*b*-1. The location of partitioning is positioned on a movable iron core side end surface of the fixed iron core 401, that is, is positioned above the end surface 401*b*-3 of the first outer circumferential fixed iron core 401*b*-1 (on the outer circumferential surface of the second outer circumferential fixed iron core 401*b*-2). The outer circumferential surfaces of three metal components form the outer circumferential surface of the metal housing that surrounds the electromagnetic drive unit 4.

As illustrated in FIG. 2, a center line 401*b*-5 of the outer circumferential fixed iron core 401*b* radially changes its direction in the first outer circumferential fixed iron core 401*b*-1. That is, with a region, in which the direction of the center line 401*b*-5 is radially changed, being as a point of reference, the center line 401*b*-5 is radially offset on the surface that is opposite to the surface facing the movable iron core 402. In the first outer circumferential fixed iron core 401*b*-1 that is positioned below the coil 403, the center line 401*b*-5 is offset inwards by d in a radial direction (close to the center) from an outer circumferential end portion of the winding portion of the coil 403, and is parallel to the central axis 1*a* of the electromagnetic fuel injector. Accordingly, the outer circumferential fixed iron core 401*b* includes a magnetic path that is parallel to the inner circumferential fixed iron core 401*a* below the winding portion of the coil 403. As a result, at least a portion of the end surface 401*b*-3, which serves as the magnetic pole of the first outer circumferential fixed iron core 401*b*-1, is interposed between the winding portion of the coil 403 and the movable iron core 402.

As illustrated in FIG. 2, the magnetic path of the outer circumferential fixed iron core 401*b* is formed in such a way as to run from an outer circumferential side of the coil 403 to a lower side of the coil 403, and the magnetic pole surface is positioned inwards (close to the center) in the radial direction from the outer circumferential end portion of the coil 403. Accordingly, it is possible to ensure a magnetic pole area of the outer circumferential fixed iron core 401*b* without increasing the outer diameter of the main body of the electromagnetic fuel injector 1. In conjunction with this configuration, the non-magnetic portion 401*d* has a longitudinal sectional shape in which a length in the direction of the central axis 1*a* is greater than a radial width.

When energy for welding is applied to a member made of a magnetic material, and the member is heated, magnetism may be lost or be decreased. In particular, when sealability is not required, spot welding or the like may be performed, and a heated portion may be limited to a narrow range. Magnetism which is decreased due to heating associated with welding can be restored via annealing.

The present invention is not limited to the configurations in the embodiments, and includes various modification examples. For example, the embodiments have been described in detail so as to easily describe the present invention, and the present invention is not necessarily limited to an embodiment including all of the configurational elements. A portion of configurational elements of an embodiment can be replaced with configurational elements of another embodiment, and configurational elements of another embodiment can be added to the configuration of an embodiment. Other configurational elements can be added to, be removed from, or be replaced with a portion of the configuration of each of the embodiments.

REFERENCE SIGNS LIST

1: electromagnetic fuel injector 1
1*a*: central axis of electromagnetic fuel injector
2: fuel supply unit
3: valve unit
4: electromagnetic drive unit
101: plunger rod
101*a*: diameter expansion portion of plunger rod 101
101*a*-1: lower end surface of diameter expansion portion
105: through hole in direction of central axis
111: nozzle body
111*a*: inner circumferential surface of concave portion

111*b*: lower end surface of accommodation chamber that accommodates movable iron core and second spring member
111*c*: inner circumferential surface
111*d*: accommodation space
119: terminal
120: resin molding
120*a*: connector
150: assembly
201: fuel pipe
201*a*: fuel supply port
201*b*: diameter expansion portion of fuel pipe 201
202: O-ring
203*a*, 203*b*: backup ring
204: filter
301: injection hole formation member
301*a*: fuel injection hole
301*b*: valve seat
302: guide member
302*a*: fuel passage
303: valve body
401: fixed iron core
401*a*: inner circumferential fixed iron core
401*a*-1: end surface of inner circumferential fixed iron core 401*a*
401*a*-2: end portion of inner circumferential fixed iron core 401*a*
401*b*: outer circumferential fixed iron core
401*b*-1: first outer circumferential fixed iron core portion
401*b*-1*a*: thin wall portion
401*b*-2: second outer circumferential fixed iron core portion
401*b*-2*a*: thin wall portion
401*b*-3: end surface of outer circumferential fixed iron core 401*b*
401*b*-4: end portion of outer circumferential fixed iron core 401*b*
401*c*: upper fixed iron core
401*d*: non-magnetic portion
401*d*-1: annular concave portion
401*d*-2: non-magnetic region
401*d*-3: void
401*d*-4: joining surface
401*d*-4: joining surface
401*d*-6: surface
401*d*-7: surface
401*d*-8: imaginary plane
401*e*: accommodation space
402: movable iron core
402*a*: first movable iron core
402*a*-1: outer circumferential surface of first movable iron core 402*a*
402*a*-2: upper end surface of first movable iron core 402*a*
402*a*-3: concave portion of first movable iron core 402*a*
402*b*: second movable iron core
402*b*-1: concave portion of second movable iron core 402*b*
402*b*-2: upper end surface of second movable iron core 402*b*
402*b*-3: lower end surface of second movable iron core 402*b*
402*b*-4: disk-shaped portion of second movable iron core 402*b*
402*b*-5: convex portion
402*b*-6: inner circumferential surface
402*b*-7: bottom surface
403: coil
404: first spring member
405: spring force adjustment member
406: second spring member
407: bobbin

The invention claimed is:

1. An electromagnetic fuel injector that includes a valve body, a movable element that drives the valve body, and a coil for driving the movable element, the electromagnetic fuel injector comprising:

a first stator that is disposed in such a way as to face the movable element;

a non-magnetic portion that is disposed closer to an inner circumferential side than the first stator, and faces the movable element;

a second stator that is formed separately from the first stator, and is assembled with the first stator in a state where the second stator is in contact with the first stator in an axial direction;

a third stator that is formed separately from the first stator and the second stator, and is disposed on an inner circumferential side of the non-magnetic portion, wherein the first stator, the non-magnetic portion, and the third stator, are all separated from the movable element, along a longitudinal axis of the electromagnetic fuel injector, by a gap having a same length along the longitudinal axis of the electromagnetic fuel injector, and the non-magnetic portion has an annular concave portion which is circumferentially formed in an outer circumferential surface of the non-magnetic portion, a bottom portion of the annular concave portion is fixed to the third stator by circumferential welding, and a gap between an inner circumferential surface of the non-magnetic portion and an outer circumferential surface of the third stator is sealed, and a gap between the outer circumferential surface of the non-magnetic portion and the third stator is sealed.

2. The electromagnetic fuel injector according to claim 1, wherein the first stator and the second stator are welded from an outer circumferential side such that the first stator and the second stator are fixed.

3. An electromagnetic fuel injector that includes a valve body, a movable element that drives the valve body, and a coil for driving the movable element, the electromagnetic fuel injector comprising:

a first stator that is disposed in such a way as to face the movable element;

a member that is disposed closer to an inner circumferential side than the first stator, and is welded at a location different from a surface which faces the movable element;

a second stator that is formed separately from the first stator, and is assembled with the first stator in such a way that the second stator is in contact with the first stator in an axial direction; and a third stator that is formed separately from the first stator and the second stator, and is disposed on an inner circumferential side of the member, wherein the first stator, the member, and the third stator are all separated from the movable element, along a longitudinal axis of the electromagnetic fuel injector, by a gap having a same length along the longitudinal axis of the electromagnetic fuel injector, and the member has an annular concave portion which is circumferentially formed in an outer circumferential surface of the non-magnetic portion, a bottom portion of the annular concave portion is fixed to their stator by circumferential welding, and the third stator is sealed, and a gap between the outer circumferential surface of the non-magnetic portion and the third stator is sealed.

4. An electromagnetic fuel injector that includes an electromagnetic drive unit that has a coil, a first stator a second stator, a third stator, and a non-magnetic portion that is welded to the third stator to define a fixed iron core, and a movable iron core, and a valve unit that has a valve body which is driven by the electromagnetic drive unit such that the valve body is opened and closed, wherein the fixed iron core includes an outer circumferential fixed iron core that forms an outer circumferential magnetic path on an outer circumferential side, and an inner circumferential fixed iron core that forms an inner circumferential magnetic path on an inner circumferential side, with the coil interposed between the outer circumferential fixed iron core and the inner circumferential fixed iron core, wherein the electromagnetic fuel injector comprises:

a non-magnetic portion that is provided between the outer circumferential fixed iron core and the inner circumferential fixed iron core, and faces the movable iron core, wherein the non-magnetic portion is provided such that energy required to perform a heat treatment is applied to a portion of the non-magnetic portion, which is positioned differently from a surface of the non-magnetic portion which faces the movable iron core, the first stator and the non-magnetic portion are both separated from the movable iron core, along a longitudinal axis of the electromagnetic fuel injector, by a gap having a same length along the longitudinal axis of the electromagnetic fuel injector, the non-magnetic portion has an annular concave portion which is circumferentially formed in an outer circumferential surface of the non-magnetic portion, a bottom portion of the annular concave portion is fixed to a third stator by circumferential welding, and a gap between an inner circumferential surface of the non-magnetic portion and third stator is sealed, and a gap between the outer circumferential surface of the non-magnetic portion and the third stator is sealed.

5. The electromagnetic fuel injector according to claim 4, wherein the outer circumferential surfaces of the first stator and the second stator form the outer circumferential surface of a housing.

6. The electromagnetic fuel injector according to claim 5, wherein a contact portion between the first stator and the second stator is positioned closer to the movable iron core than an end portion of the coil which is opposite to the movable iron core.

7. The electromagnetic fuel injector according to claim 4, wherein a housing component, which accommodates the movable iron core, is connected to a portion of the first stator which is opposite to the contact portion between the first stator and the second stator, and wherein the maximum-diameter portion of a housing unit, which accommodates the electromagnetic drive unit, is configured to have three components, that is, the first stator, the second stator, and the housing component.

8. The electromagnetic fuel injector according to claim 4, wherein the gap is formed between an end surface of the outer circumferential fixed iron core, which serves as a magnetic pole, and an end surface of the inner circumferential fixed iron core, which serves as a magnetic pole is set to be smaller than a radial dimension of a coil assembly that includes the coil and a bobbin around which the coil is wound, and wherein the fixed iron core is configured such that the coil assembly can be assembled from a side opposite to the facing end surfaces of the outer circumferential fixed iron core and the inner circumferential fixed iron core.

9. The electromagnetic fuel injector according to claim 4, wherein the non-magnetic portion is formed in an annular shape, and an axial dimension of the non-magnetic portion is greater than a radial thickness dimension thereof.

10. The electromagnetic fuel injector according to claim 4, wherein the fixed iron core is configured to include the outer circumferential fixed iron core that is a first yoke component; the inner circumferential fixed iron core that is a second yoke component; and a third yoke component that is connected to end portions of the outer circumferential fixed iron core and the inner circumferential fixed iron core, and is bridged between the outer circumferential fixed iron core and the inner circumferential fixed iron core, with the end portions being opposite to the facing end surfaces of the inner circumferential fixed iron core and the outer circumferential fixed iron core.

11. The electromagnetic fuel injector according to claim 4, wherein the inner circumferential fixed iron core and a first outer circumferential fixed iron core portion which are connected together via a non-magnetic region are integrally formed as a single member, wherein the non-magnetic portion is formed by applying a non-magnetization process to the same material as that of the inner circumferential fixed iron core and the first stator, wherein a void is formed between the inner circumferential fixed iron core and the first stator in such a way as to be adjacent to the non-magnetic portion and to face the movable iron core, and wherein the non-magnetic portion is configured to include the non-magnetic region and the void.

12. The electromagnetic fuel injector according to claim 4, wherein either one of the inner circumferential fixed iron core and the first stator is formed integrally with the non-magnetic region, wherein the non-magnetic portion is formed by applying a non-magnetization process to the same material as that of the inner circumferential fixed iron core or the first stator, wherein a void is formed between the inner circumferential fixed iron core and the first stator in such a way as to be adjacent to the non-magnetic portion and to face the movable iron core, and wherein the non-magnetic portion is configured to include the non-magnetic region and the void.

13. The electromagnetic fuel injector according to claim 1, wherein at least a portion of the facing end surfaces of the first stator and the movable element is interposed between a winding portion of the coil and the movable element.

14. The electromagnetic fuel injector according to claim 1, further comprising a first movable iron core and a second movable iron core, wherein a first gap is formed between an upper end surface of the first movable iron core and an end surface of the third stator, a second gap is formed between an upper end surface of the second movable iron core and the end surface of the third stator, and between the upper end surface of the second movable iron core and the third stator, and the first gap is larger than second gap.

15. The electromagnetic fuel injector according to claim 3, further comprising a first movable iron core and a second movable iron core, wherein a first gap is formed between an upper end surface of the first movable iron core and an end surface of the third stator, a second gap is formed between an upper end surface of the second movable iron core and the end surface of the third stator, and between the upper end surface of the second movable iron core and the end surface of the third stator, and the first gap is larger than second gap.

16. The electromagnetic fuel injector according to claim 4, further comprising a first movable iron core and a second movable iron core, wherein a first gap is formed between an upper end surface of the first movable iron core and an end surface of the inner circumferential fixed iron core, a second gap is formed between an upper end surface of the second movable iron core and the end surface of the inner circumferential fixed iron core, and between the upper end surface of the second movable iron core and the end surface of the outer circumferential fixed iron core, and the first gap is larger than second gap.

* * * * *